US006870140B2

(12) United States Patent
Cook et al.

(10) Patent No.: US 6,870,140 B2
(45) Date of Patent: Mar. 22, 2005

(54) UNIVERSAL FUSER HEATING APPARATUS WITH EFFECTIVE RESISTANCE SWITCHED RESPONSIVE TO INPUT AC LINE VOLTAGE

(75) Inventors: William P. Cook, Lexington, KY (US); Mark K. DeMoor, Nicholasville, KY (US); Steven J. Harris, Lexington, KY (US); John W. Kietzman, Lexington, KY (US); Gregory H. McClure, Lexington, KY (US); Jerry W. Smith, Irvine, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/442,866

(22) Filed: May 21, 2003

(65) Prior Publication Data

US 2004/0232137 A1 Nov. 25, 2004

(51) Int. Cl.[7] ..... H05B 1/02; G03G 15/00

(52) U.S. Cl. ..... 219/486; 219/216; 399/69; 399/335

(58) Field of Search ..... 219/486–487, 219/488, 492, 494, 216, 471; 399/67, 69, 335–338

(56) References Cited

U.S. PATENT DOCUMENTS

| | | | | |
|---|---|---|---|---|
| 3,398,259 | A | | 8/1968 | Tregay et al. |
| 3,998,539 | A | * | 12/1976 | Kidd ..... 399/178 |
| 4,340,807 | A | | 7/1982 | Raskin et al. |
| 4,576,462 | A | | 3/1986 | Lehman |
| 4,825,242 | A | | 4/1989 | Elter |
| 5,041,718 | A | | 8/1991 | d'Hondt et al. |
| 5,300,996 | A | | 4/1994 | Yokoyama et al. |
| 5,350,896 | A | | 9/1994 | Amico et al. |
| 5,376,773 | A | | 12/1994 | Masuda et al. |
| 5,483,149 | A | | 1/1996 | Barrett |
| 5,497,218 | A | | 3/1996 | Amico |
| 5,512,993 | A | | 4/1996 | Endo et al. |
| 5,671,462 | A | | 9/1997 | Toyohara et al. |
| 5,708,949 | A | | 1/1998 | Kasahara et al. |
| 5,789,723 | A | | 8/1998 | Hirst |
| 5,819,134 | A | | 10/1998 | Sato et al. |
| 5,826,152 | A | | 10/1998 | Suzuki et al. |
| 5,854,959 | A | | 12/1998 | Mirabella, Jr. |
| 5,862,436 | A | | 1/1999 | Ishizawa et al. |
| 5,899,599 | A | | 5/1999 | Kato |
| 6,008,829 | A | | 12/1999 | Wakamiya et al. |
| 6,011,939 | A | | 1/2000 | Martin |
| 6,178,299 | B1 | | 1/2001 | Kim |
| 6,229,120 | B1 | | 5/2001 | Jewell |
| 6,243,547 | B1 | | 6/2001 | Mizuno et al. |

(List continued on next page.)

FOREIGN PATENT DOCUMENTS

| | | | |
|---|---|---|---|
| JP | 5-249864 | * | 9/1993 |
| JP | 5-346749 | * | 12/1993 |
| JP | 7-121055 | * | 5/1995 |
| JP | 11-233243 | * | 8/1999 |
| JP | 2001-142547 | * | 5/2001 |
| JP | 2002-43028 | * | 2/2002 |
| JP | 2002-55554 | * | 2/2002 |

*Primary Examiner*—John A. Jeffery
(74) *Attorney, Agent, or Firm*—Stevens & Showalter, LLP

(57) ABSTRACT

A plurality of universal fuser heating apparatus embodiments are provided, each of which is capable of receiving any one of a number of input AC line voltages falling within at least two AC line voltage ranges. In each embodiment, the fuser heating apparatus has a first, low effective resistance corresponding to AC line voltages falling within low AC line voltage ranges and a second, high effective resistance corresponding to AC line voltages falling within high AC line voltage ranges.

33 Claims, 15 Drawing Sheets

U.S. PATENT DOCUMENTS

| | | | |
|---|---|---|---|
| 6,289,185 | B1 | 9/2001 | Cahill |
| 6,301,454 | B1 | 10/2001 | Nishida et al. |
| 6,336,009 | B1 | 1/2002 | Suzumi et al. |
| 6,353,718 | B1 | 3/2002 | Roxon et al. |
| 6,385,410 | B1 | 5/2002 | Hanyu et al. |
| 6,423,941 | B1 | 7/2002 | Kanari et al. |
| 6,522,844 | B2 | 2/2003 | Yamane et al. |
| 6,539,185 | B2 | 3/2003 | Hanyu et al. |
| 2002/0043523 | A1 | 4/2002 | Fujita et al. |
| 2002/0061199 | A1 | 5/2002 | Horobin et al. |
| 2002/0085851 | A1 | 7/2002 | Murata et al. |

* cited by examiner

UNIVERSAL FUSER HEATING APPARATUS WITH EFFECTIVE RESISTANCE SWITCHED RESPONSIVE TO INPUT AC LINE VOLTAGE

BACKGROUND OF THE INVENTION

Fuser systems for printers, copiers and like devices are typically designed to receive an AC line voltage falling within a narrow voltage range, e.g., 90 VAC to about 110 VAC, typical in Japan, 100 VAC to about 127 VAC, typical in the U.S., and 200 VAC to about 240 VAC, also typical in the U.S. and Europe as well. It would be desirable from a device distribution standpoint to have a universal fuser heating apparatus forming part of a fuser subassembly capable of working in each of these AC line voltage ranges so that fewer unique printer, or copier models would be needed for distribution.

U.S. Pat. No. 5,483,149 discloses a fuser control system, which permits a fuser having a lamp designed for a very narrow AC line voltage range to be used over a wide range of AC line voltages. The '149 patent teaches determining a ratio of the rated power for the fuser lamp to an amount of power available based on the input AC line voltage and the resistance of the fuser lamp. A control signal for controlling the operation of a zero-crossing switch is generated having a duty cycle substantially equal to the determined ratio. The zero crossing switch, in accordance with the control signal, provides half cycles of an AC power signal to the fuser lamp. Hence, average power dissipated by the lamp is maintained at a level substantially equal to the rated power level for the fuser lamp by allowing only a portion of the available AC power signal to be provided to the lamp. Where fuser lamps designed for low AC line voltages and, hence, having low resistances, are used with high input AC line voltage, the average power dissipated by the fuser lamps is maintained at a desirable level by defining low duty cycles of the high AC line voltage. Unfortunately, the fuser lamps so actuated result in high current levels, which oftentimes create unacceptable flicker problems.

Accordingly, there is a need for an improved universal fuser heating apparatus capable of working over low and high AC line voltage ranges, which does not cause unacceptable flicker problems.

BRIEF SUMMARY OF THE INVENTION

This need is met by the present invention wherein a plurality of universal fuser heating apparatus embodiments are provided, each of which is capable of receiving any one of a number of input AC line voltages falling within at least two AC line voltage ranges. In each embodiment, the fuser heating apparatus has a first, low effective resistance corresponding to AC line voltages falling within low AC line voltage ranges and a second, high effective resistance corresponding to AC line voltages falling within high AC line voltage ranges. Consequently, regardless of the AC line voltage provided, high current levels, which might create unacceptable flicker problems, are avoided.

In accordance with a first aspect of the present invention, a universal fuser heating apparatus is provided capable of receiving an input AC line voltage falling within at least one low AC line voltage range or a high AC line voltage range. The universal fuser heating apparatus comprises a first resistive heating element; a second resistive heating element; and structure for coupling the first and second resistive heating elements in series or in parallel in dependence upon whether the fuser heating apparatus will receive an input AC line voltage falling within the at least one low AC line voltage range or the high AC line voltage range.

The structure may comprise an element capable of being manually moved between first and second positions. The element is moved to the first position so as to couple first ends of the first and second resistive heating elements to a first terminal of a first power source generating an AC line voltage falling within the at least one low AC line voltage range and second ends of the first and second resistive heating elements to a second terminal of the first power source such that the first and second resistive heating elements are in parallel with one another. The element is moved to the second position so as to couple the first end of the first resistive heating element to a first terminal of a second power source generating an AC line voltage falling within the high AC line voltage range and the first end of the second resistive heating element to the second terminal of the second power source such that the first and second resistive heating elements are in series with one another.

The movable element may comprise a movable jumper switch or a movable connector.

The at least one low AC line voltage range may comprise a first low AC line voltage range and a second low AC line voltage range. The first low AC line voltage range is from about 90 VAC to about 110 VAC, the second low AC line voltage range is from about 100 VAC to about 127 VAC and the high AC line voltage range is from about 200 VAC to about 240 VAC.

Alternatively, the structure may comprise a first switching element; a second switching element; an input voltage range detector for detecting whether the input AC line voltage falls within the at least one low AC line voltage range or the high AC line voltage range; and a processor coupled to the first and second switching elements and the input voltage range detector. When the input voltage range detector detects that the input AC line voltage falls within the at least one low AC line voltage range the processor turns the first switching element OFF such that the first switching element couples a first end of the second resistive heating element to a first terminal of a first power source generating the AC line voltage falling within the at least one low AC line voltage range and turns the second switching element ON such that the second switching element couples second ends of the first and second resistive heating elements to a second terminal of the first power source. The first and second resistive heating elements are in parallel with one another when the first switching element is OFF and the second switching element is ON. When the input voltage range detector detects that the input AC line voltage falls within the high voltage range the processor turns the first switching element ON such that the first switching element couples the first end of the second resistive heating element to a second terminal of a second power source generating the AC line voltage falling within the high AC line voltage range and turns the second switching element OFF such that the second switching element decouples the second ends of the first and second resistive heating elements from the second terminal of the second power source. The first and second resistive heating elements are in series with one another when the first switching element is ON and the second switching element is OFF.

The fuser heating apparatus may further comprise a first switching device associated with the first resistive heating element and a second switching device associated with the second resistive heating element, where the first and second switching devices are coupled to and controlled by the processor. The processor may activate the first and second switching devices in accordance with an integer half-cycle control scheme so as to control the amount of power provided to the first and second resistive heating elements. The processor may also activate the first and second switching devices in one of a concurrent activation mode and a frequency-doubling mode.

The first switching device may comprise a first triac coupled to the first end of the first resistive heating element and the second switching device may comprise a second triac coupled to the first end of the second resistive heating element.

The universal fuser heating apparatus may further comprise at least one thermal cut off device positioned adjacent to one of the first and second resistive heating elements.

The first and second resistive heating elements may comprise first and second lamps; first and second resistive traces; or first and second filaments within a dual filament lamp.

In accordance with a second aspect of the present invention, a universal fuser heating apparatus is provided capable of receiving an input AC line voltage generated by a power source. The AC line voltage falls within at least one low AC line voltage range or a high AC line voltage range. The universal fuser heating apparatus comprises a first resistive heating element rated for receiving an AC line voltage falling within the at least one low AC line voltage range; a second resistive heating element rated for receiving an AC line voltage falling within the high voltage range; and structure for coupling at least one of the first and second resistive heating elements to the power source in dependence upon whether the AC line voltage generated by the power source falls within the at least one low AC line voltage range or the high voltage range.

The structure may comprise a first element capable of being manually moved between at least first and second positions. The first element is moved to the first position when the AC line voltage generated by the power source falls within the at least one low AC line voltage range so as to couple a first end of the first resistive heating element to a first terminal of the power source and a second end of the first resistive heating element to a second terminal of the power source. The first element is moved to the second position when the AC line voltage generated by the power source falls within the high voltage range so as to couple a first end of the second resistive heating element to the first terminal of the power source and a second end of the second resistive heating element to the second terminal of the power source.

The first resistive heating element generally has a resistance which is lower than that of the second resistive heating element.

The at least one AC line voltage range may include a first low AC line voltage range and a second low AC line voltage range. At least a portion of the first low AC line voltage range is less than the entire second, low AC line voltage range. The first element is moved to the first position when the AC line voltage generated by the power source falls within the second low AC line voltage range. The first element is capable of being moved to a third position when the AC line voltage generated by the power source falls within the first low AC line voltage range so as to couple the first ends of the first and second resistive heating elements to a first terminal of the power source thereby causing the first and second resistive heating elements to be in parallel with one another.

Alternatively, instead of the first element being movable to a third position, a second element may be provided. When the AC line voltage generated by the power source falls within the first low AC line voltage range, the second element is actuated so as to couple the first ends of the first and second resistive heating elements to a first terminal of the power source thereby causing the first and second resistive heating elements to be in parallel with one another.

The first and second resistive heating elements may comprise first and second lamps; first and second resistive traces; or first and second filaments within a dual filament lamp.

Alternatively, the structure may comprise a first switching device; a second switching device; an input voltage range detector for detecting whether the input AC line voltage falls within the at least one low voltage range or the high voltage range; and a processor coupled to the first and second switching devices and the input voltage range detector. When the input voltage range detector detects that the input AC line voltage falls within the at least one low voltage range the processor activates the first switching device such that the first switching device couples a first end of the first resistive heating element to a first terminal of the power source. When the input voltage range detector detects that the input AC line voltage falls within the high voltage range the processor activates the second switching device such that the second switching device couples the first end of the second resistive heating element to the first terminal of the power source.

The processor may activate the first switching device in accordance with an integer half-cycle control scheme so as to control the amount of power provided to the first resistive heating element when the input voltage range detector detects that the input AC line voltage falls within the at least one low voltage range, and the processor may activate the second switching device in accordance with an integer half-cycle control scheme so as to control the amount of power provided to the second resistive heating element when the input voltage range detector detects that the input AC line voltage falls within the high voltage range.

The first switching device may comprise a first triac coupled to the first end of the first resistive heating element and the second switching device may comprise a second triac coupled to the first end of the second resistive heating element.

The at least one AC line voltage range may include a first low AC line voltage range and a second low AC line voltage range. At least a portion of the first low AC line voltage range is less than the entire second low AC line voltage range. The processor activates the first and second switching devices when the AC line voltage generated by the power source falls within the first low AC line voltage range so as to couple the first ends of the first and second resistive heating elements to a first terminal of the power source thereby causing the first and second resistive heating elements to be in parallel with one another.

In accordance with a third aspect of the present invention, a fuser heating apparatus capable of receiving an input AC line voltage is provided and comprises a first resistive heating element; a second resistive heating element; a first switching device associated with the first resistive heating element; a second switching device associated with the second resistive heating element; and a processor coupled to the first and second switching devices. The processor activates the first and second switching devices in accordance with an integer half-cycle control in a frequency doubling mode so as to control the amount of power provided to the first and second resistive heating elements. Integer half-cycle control in a frequency double mode only occurs when the input AC line voltage falls within the second low AC line voltage range. The first and second switching devices may comprise first and second triacs.

In accordance with a further aspect of the present invention, a resistive heater is provided which is adapted for heating a fuser belt comprising: a substrate; a first resistive trace formed over the substrate; and a second resistive trace formed so as to at least partially overlap the first resistive trace.

A first insulation layer may be provided over the first resistive trace. A second insulation layer may be provided over the second resistive trace.

In accordance with one embodiment of the present invention, the first resistive trace comprises first and second subtraces. A first conductor may extend from a first end of the first subtrace. The first end of the second subtrace may be coupled to a second conductor and second ends of the first and second subtraces may be coupled together by a third conductor.

The second resistive trace may comprise third and fourth subtraces. A fourth conductor may extend from a first end of the third subtrace. The first end of the fourth subtrace may be coupled to a fifth conductor and second ends of the third and fourth subtraces may be coupled together by a sixth conductor.

In accordance with another embodiment of the present invention, each of the first and second resistive traces comprises only a single resistive trace.

A first end of the first resistive trace may be coupled to a first conductor. A first end of the second resistive trace may be coupled to a second conductor, and second ends of the first and second resistive traces may be coupled to a third conductor.

In both embodiments, i.e., where each of the first and second resistive traces comprises only a single resistive trace or one or more subtraces, the second resistive trace may overlie a substantial portion of the first resistive trace.

BRIEF DESCRIPTION OF THE SEVERAL VIEWS OF THE DRAWINGS

FIG. 3 illustrates a universal fuser heating apparatus constructed in accordance with a second embodiment of the present invention where a first relay is OFF and a second relay is ON;

DETAILED DESCRIPTION OF THE INVENTION

Figure 1:
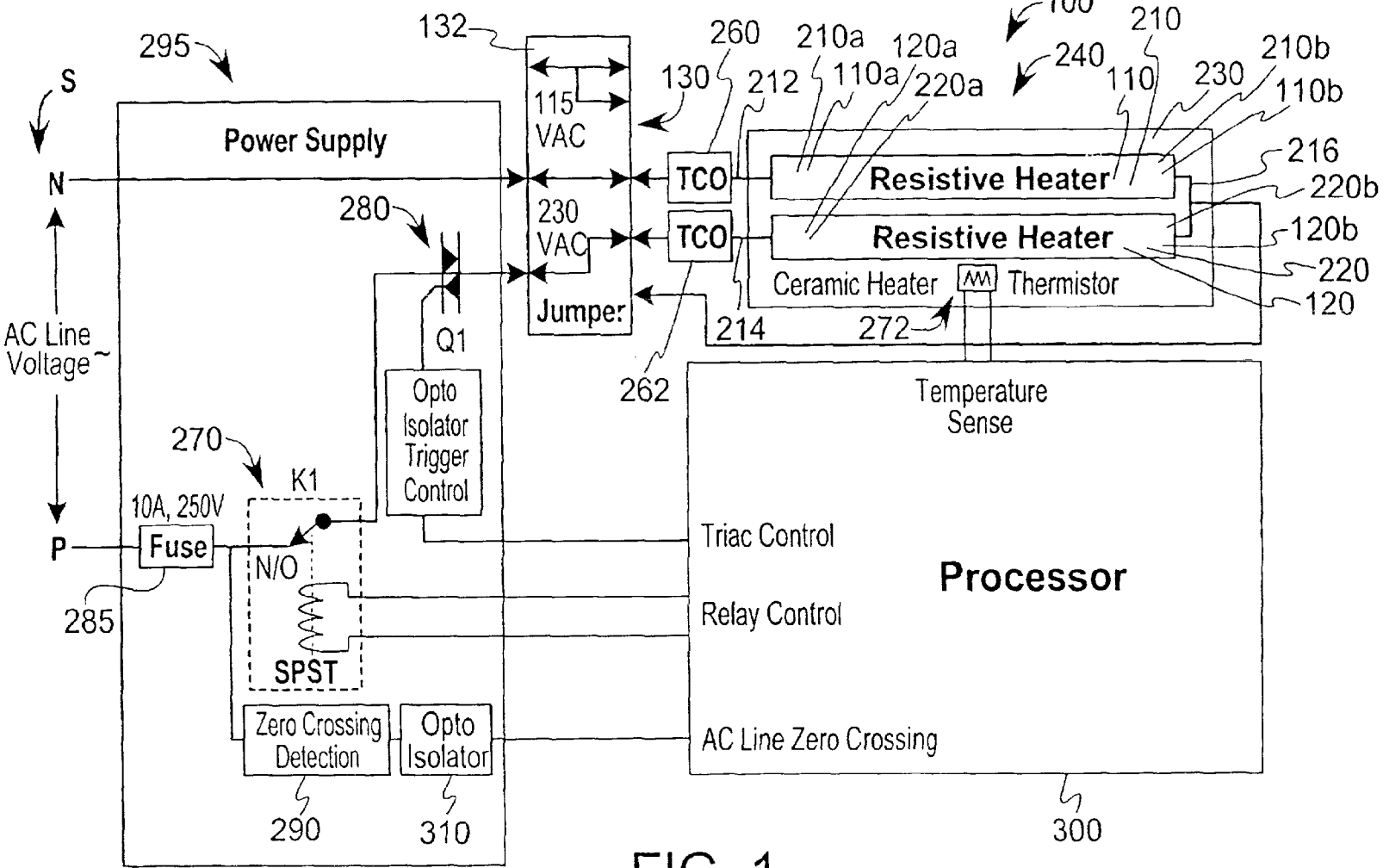
FIG. 1 is a schematic illustration of a universal fuser heating apparatus constructed in accordance with a first embodiment of the present invention where a jumper switch is illustrated in a second position.

In accordance with a first embodiment of the present invention, a universal fuser heating apparatus 100 is provided which is capable of receiving an input AC line voltage falling within one of a first low AC line voltage range, from about 90 VAC to about 110 VAC (all VAC values set out herein are root-mean-square values), a second low AC line voltage range, from about 100 VAC to about 127 VAC, and a high AC line voltage range, from about 200 VAC to about 240 VAC. The universal fuser heating apparatus 100 comprises a first resistive heating element 110; a second resistive heating element 120; and structure 130 for coupling the first and second resistive heating elements 110 and 120 in series or in parallel in dependence upon whether the apparatus 100 is to receive an input AC line voltage falling within one of the first and second low AC line voltage ranges or the high AC line voltage range.

The universal fuser heating apparatus 100 comprises part of a fuser subassembly for use in a printer, copier, facsimile machine and like devices. The fuser subassembly may further comprise a pair of fuser rolls, which define a nip for receiving a substrate having a thermoplastic toner image provided thereon. The fuser rolls, at least one of which is heated, provide energy in the form of heat to the toner image causing it to melt. When the toner image subsequently cools, it solidifies and adheres to the substrate. The fuser subassembly may alternatively comprise a heated belt and a backup roll. The belt, which is typically heated by a ceramic heater, transfers energy in the form of heat to a toned substrate causing the toner material to melt. When the toned image subsequently cools, it solidifies and adheres to the substrate. It is still further contemplated that the fuser subassembly may comprise a heated fuser roll with a backup member comprising a belt.

Each heated fuser roll or the heated belt is provided with a corresponding set of first and second heating elements 110 and 120. Hence, if each of a pair of fuser rolls is heated, then two sets of first and second heating elements 110 and 120 are provided such that each fuser roll includes a corresponding set of first and second heating elements 110 and 120. If only one fuser roll is heated, then that fuser roll will include a set of first and second heating elements 110 and 120.

In FIG. 1, the first and second resistive heating elements 110 and 120 are schematically illustrated as first and second resistive traces 210 and 220 provided on a ceramic substrate 230. The resistive traces 210 and 220 and the ceramic substrate 230 define a ceramic heater 240, which is adapted to provide heat energy to a fuser belt. In FIG. 1, a first metal conductor 212 extends from a first end 210*a* of the first resistive trace 210 and a second metal conductor 214 extends from a first end 220*a* of the second resistive trace 220. A third metal conductor 216 is coupled to second ends 210*b* and 220*b* of the first and second traces 210 and 220.

Figure 1A:
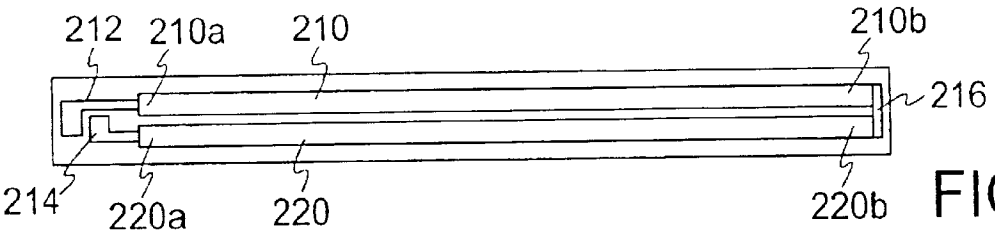
FIGS. 1A–1D illustrate alternative embodiments of resistive traces for use with universal fuser heating apparatuses constructed in accordance with first and second embodiments of the present invention.
Figure 1B:
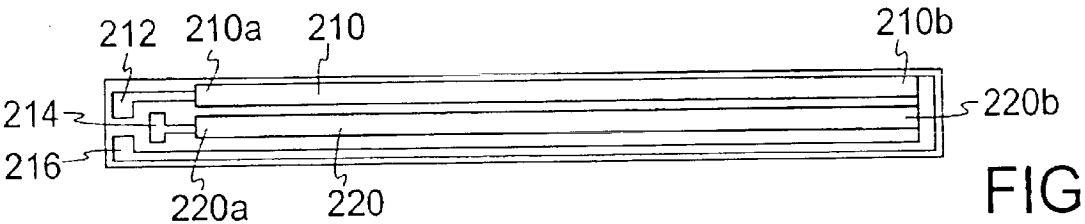
Figure 1C:
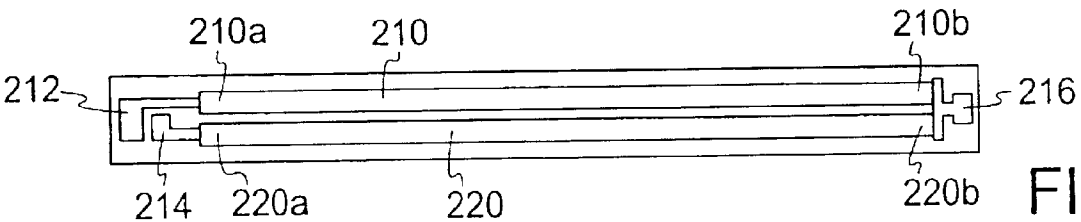
Figure 1D:
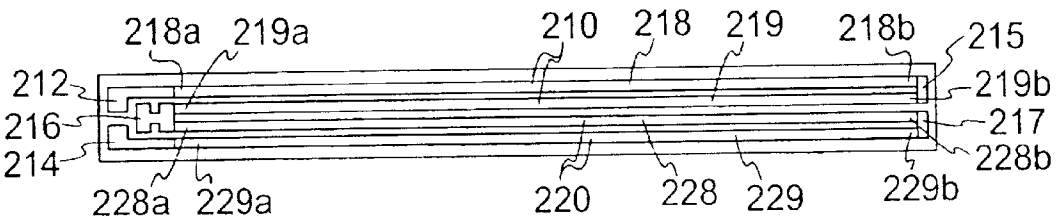

Alternative resistive trace designs, which may comprise the first and second resistive heating elements 110 and 120 illustrated in FIG. 1, are illustrated in FIGS. 1A–1D. In FIGS. 1A–1C, a first metal conductor 212 extends from a first end 210*a* of the first resistive trace 210 and a second metal conductor 214 extends from a first end 220*a* of the second resistive trace 220. A third metal conductor 216 is coupled to corresponding second ends 210*b* and 220*b* of the first and second traces 210 and 220. In the FIG. 1D embodiment, the first trace 210 is defined by first and second sub-traces 218 and 219 and the second trace 220 is defined by third and fourth sub-traces 228 and 229. The first metal conductor 212 extends from a first end 218*a* of the first sub-trace 218, the second metal conductor 214 extends from a first end 229*a* of the fourth sub-trace 229, and the third metal conductor 216 is coupled to first ends 219*a* and 228*a* of the second and third sub-traces. A fourth metal conductor 215 is coupled to second ends 218*b* and 219*b* of the first and second sub-traces 218 and 219 and a fifth metal conductor 217 is coupled to second ends 228*b*, 229*b* of the third and fourth sub-traces 228 and 229.

Figure 1E:
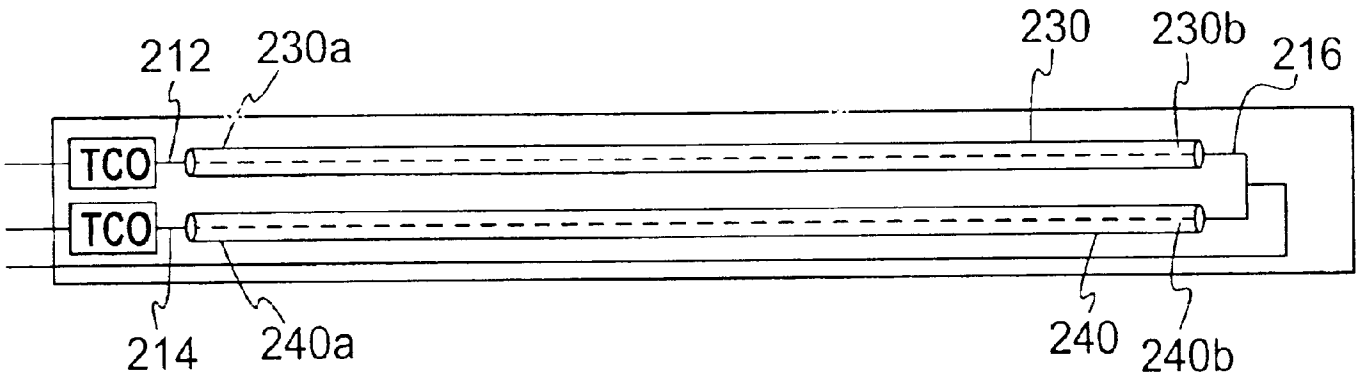
FIG. 1E illustrates first and second lamps.

It is also contemplated that the first and second resistive heating elements 110 and 120 may comprise first and second lamps 230 and 240, see FIG. 1E, which are capable of being positioned internally within a fuser roll. A first metal conductor 212 extends from a first end 230*a* of the lamp 230 and a second metal conductor 214 extends from a first end 240*a* of the second lamp 240. A third metal conductor 216 is coupled to corresponding second ends 230*b* and 240*b* of the first and second lamps 230 and 240. It is further contemplated that the first and second resistive heating elements 110 and 120 may comprise first and second filaments 232 and 242 within a dual filament lamp 250, see FIG. 1F. A first metal conductor 212 extends from a first end 232*a* of the first filament 232 and a second metal conductor 214 extends from a first end 242*a* of the second filament 242. A third metal conductor 216 is coupled to corresponding second ends 232*b* and 242*b* of the first and second filaments 232 and 242. The dual filament lamp 250 is used within a fuser roll.

The structure 130 comprises a jumper switch 132 (also referred to herein as an element), see FIG. 1, which is manually movable between first and second positions. The jumper switch 132 is illustrated in its second position in FIG. 1 and in its first position in FIG. 1G. When the switch 132 is positioned in its first position, see FIG. 1G, the switch 132 couples, via conductors 212 and 214, first ends 110*a* and 120*a* of the first and second resistive heating elements 10 and 120 to a first terminal, neutral terminal N in FIG. 1, of a power source or line S, and couples, via conductor 216, second ends 110*b* and 120*b* of the first and second resistive heating elements 10 and 120 to a second terminal, phase terminal P of the power source S. When the first ends 110*a* and 120*a* are coupled to the first terminal N and the second ends 110*b* and 120*b* are coupled to the second terminal P, the first and second resistive heating elements 110 and 120 are in parallel with one another. The jumper switch 132 is moved to its first position when the power source or line S is generating an AC line voltage falling within one of the first and second low AC line voltage ranges.

The jumper switch 132 is moved to its second position, as illustrated in FIG. 1, when the power source S is generating an AC line voltage falling within the high AC line voltage range. When moved to the second position, the jumper switch 132 couples, via conductor 212, the first end 110*a* of the first resistive heating element 110 to the first terminal N of the power source S and also couples, via conductor 214, the first end 120*a* of the second resistive heating element 120 to the second terminal P of the power source S. The conductor 216 couples the second ends of the first and second resistive heating elements 110 and 120 to one another. Hence, when the jumper switch 132 is in its second position, the first and second resistive heating elements 110 and 120 are in series with one another.

The jumper switch 132 is selectively engaged with a jumper terminal block (not shown) in the printer, copier or other device in which the universal fuser heating apparatus 100 is incorporated in either its first or second position. The jumper switch 132 and jumper terminal block may be positioned within the fuser subassembly, e.g., in a removable fuser subassembly module, or in another location, i.e., not in the fuser subassembly, in the printer, copier or other device.

Figure 1F:
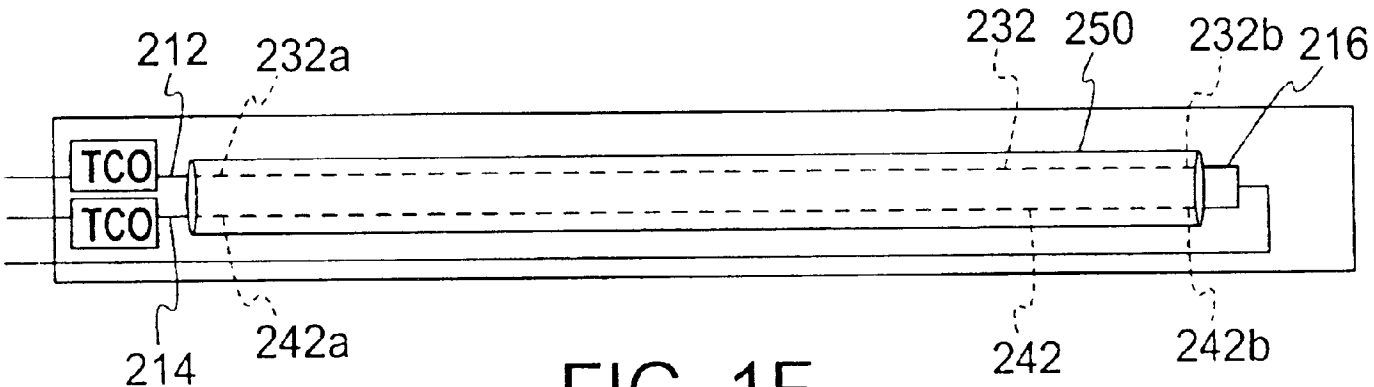
FIG. 1F illustrates a dual filament lamp.
Figure 1G:
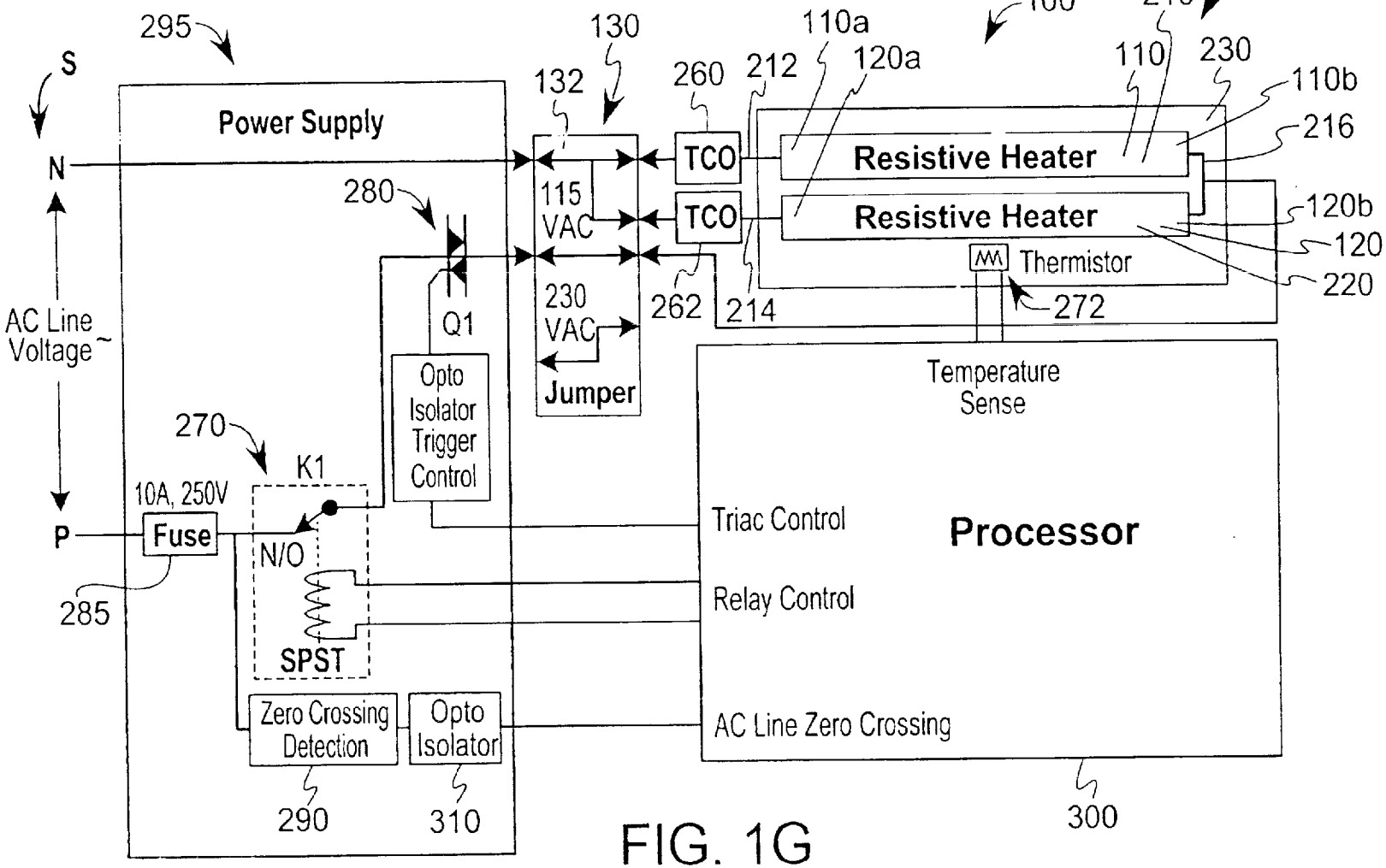
FIG. 1G is a schematic illustration of the universal fuser heating apparatus constructed in accordance with the first embodiment of the present invention where the jumper switch is illustrated in a first position.
Figure 1H:
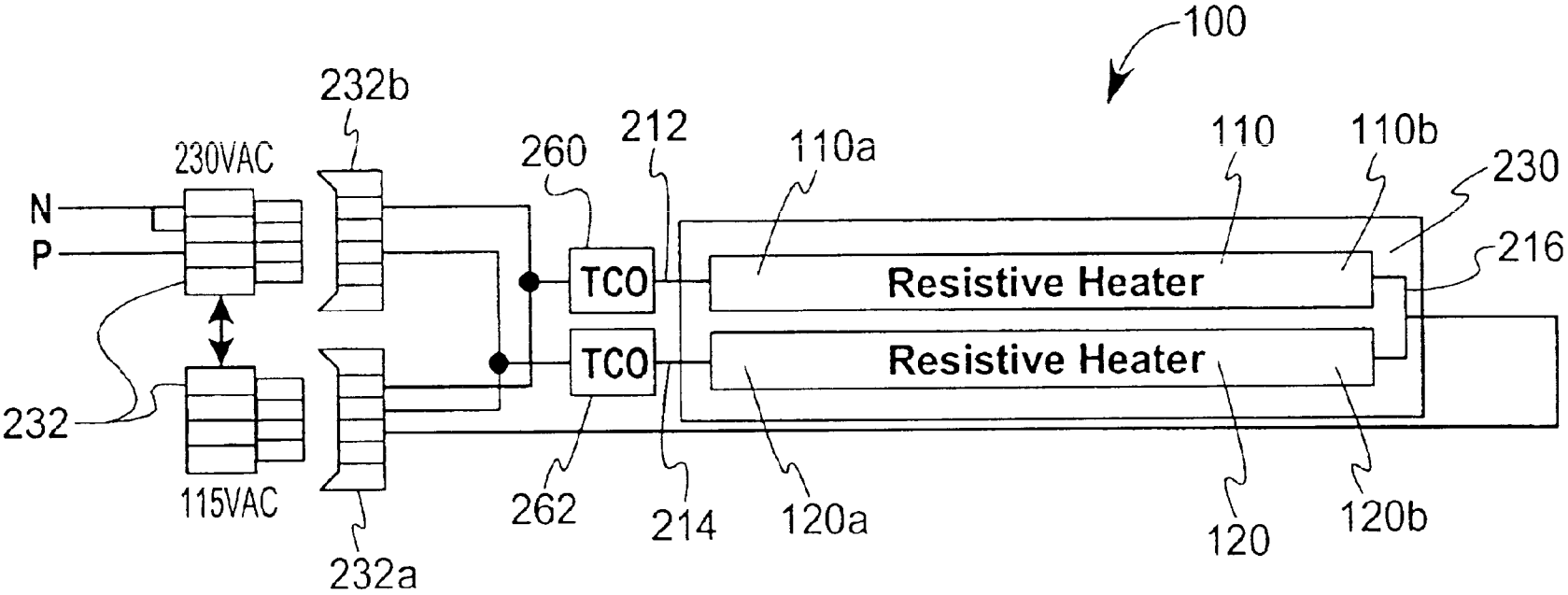
FIG. 1H is a schematic illustration of a universal fuser heating apparatus constructed in accordance with the first embodiment of the present invention where a connector is provided in place of a jumper switch.

In an alternative embodiment, a manually movable connector 232 is provided in place of the jumper switch 132, see FIG. 1H. The connector 232 is movable between first and second positions. When the connector 232 is positioned in its first position, shown in phantom in FIG. 1H coupled to heater connector 232*a*, the connector 232 couples, via conductors 212 and 214, the first ends 110*a* and 120*a* of the first and second resistive heating elements 110 and 120 to the first terminal N of the power source or line S and couples, via conductor 216, second ends 10*b* and 120*b* of the first and second resistive heating elements 110 and 120 to the second terminal P of the power source S. When the first ends 10*a* and 120*a* are coupled to the first terminal N and the second ends 110*b* and 120*b* are coupled to the second terminal P, the first and second resistive heating elements 110 and 120 are in parallel with one another. The connector 232 is moved to its first position when the power source S is generating an AC line voltage falling within one of the first and second low AC line voltage ranges.

The connector 232 is moved to its second position, shown in solid line in FIG. 1H coupled to heater connector 232*b*, so as to couple, via conductor 212, the first end 110*a* of the first resistive heating element 110 to the first terminal N of the power source S and also couple, via conductor 214, the first end 120*a* of the second resistive heating element 120 to the second terminal P of the power source S. The conductor 216 couples the second ends of the first and second resistive heating elements 110 and 120 to one another. Hence, when the connector 232 is in its second position, the first and second resistive heating elements 110 and 120 are in series with one another. The connector 232 is moved to its second position when the power source S is generating an AC line voltage falling within the high AC line voltage range.

The connector 232 is coupled to the appropriate one of the heater connectors 232*a*, 232*b* for the required operating voltage.

In the illustrated embodiment, the resistance of the first resistive heating element 110 is substantially equal to the resistance of the second resistive heating element 120. It is also contemplated that the first and second resistive heating elements 110 and 120 may have different resistances. In either case, the resistances of the first and second heating elements 110 and 120 are selected such they have a first, low effective resistance, when in parallel with one another, corresponding to the AC line voltage falling within one of the low AC line voltage ranges, see FIGS. 1G and 1H (phantom line), and a second, high effective resistance, when in series with one another, corresponding to the AC line voltage falling within the high AC line voltage range, see FIGS. 1 and 1H (solid line). Consequently, regardless of the AC line voltage provided, high current levels, which might create unacceptable flicker problems, are avoided.

Further provided, as illustrated in FIGS. 1 and 1H, are first and second thermal cut off devices 260 and 262. The devices 260 and 262 are coupled between the jumper switch 132 or connector 232 and the conductors 212, 214. They are also positioned near or in engagement with the first and second resistive heating elements 110 and 120 so as to be heated by the heating elements 110 and 120. When the devices 260, 262 are heated to a predefined threshold temperature, they are actuated so as to disconnect a corresponding resistive heating element 110, 120 from the power source S. Hence, the thermal cut off devices 260, 262 function as thermal safety devices. The devices 260, 262 may comprise one-shot bimetal thermostats, which are commercially available from Wako Electronics Co., Ltd. (Osaka, Japan). When the first and second resistive heating elements 110, 120 comprise first and second resistive traces 210 and 220 on a ceramic substrate 230, the preferred Wako thermostat comprises "Model No. CH-16." When the first and second resistive heating elements 110 comprise lamps 230, 240 or filaments 232, 242, the preferred Wako thermostat comprises "Model No. CH-152-35."

A further thermal safety device comprises a relay 270 and a thermistor 272. In the embodiment illustrated in FIG. 1, the thermistor 272 is provided directly on the substrate 230. When the first and second resistive heating elements 110 and 120 comprise lamps 230, 240 or filaments 232, 242, the thermistor 272 is positioned in contact with the fuser roll containing the lamps 230, 240 or filaments 232, 242. A processor 300 samples the temperature signal generated by the thermistor 272. When the processor 300 determines that the temperature sensed by the thermistor 272 exceeds a predefined threshold level, the processor 300 turns the relay 270 OFF so as to decouple the first and second resistive heating elements 110, 120 from the power source S. The relay 270 may comprise a single pole, single throw relay, one of which is commercially available from "NAiS" (Matsushita Electric Works, Ltd., Automation Controls Company), under the product designation "JS1aFB24V."

A fuse 285 is coupled between the relay 270 and the second terminal P of the power source S. The fuse 285 opens if the current passing through it exceeds a threshold value. The fuser 285 may open instantaneously when the threshold current level is reached or after a predefined period of time.

The processor 300 is also coupled to a triac 280, which is provided between the relay 270 and the jumper switch 132 or connector 232, see FIGS. 1 and 1G. A zero crossing detect circuit 290 is coupled to the second terminal P of the power source S and to the processor 300 through a conventional opto-isolator circuit 310 so as to prevent the AC line voltage signal from reaching the processor 300. The zero crossing detect circuit 290 generates a pulse each time the input AC line voltage signal crosses 0 voltage. The triac 280 may comprise one which is commercially available from ST Microelectronics (Dallas, Tex.), under the product designation "BTA24-600BW."

Figure 2:
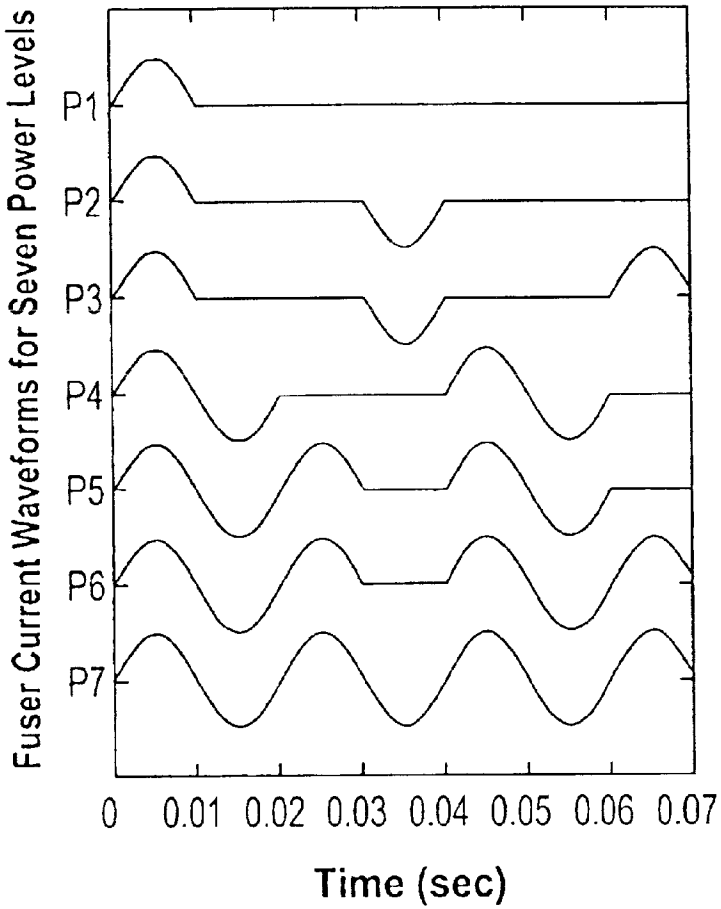
FIG. 2 illustrates current waveforms for seven power levels corresponding to integer half cycle control.

The processor 300 controls the operation of the triac 280 in accordance with an integer half-cycle control scheme when the first and second resistive heating elements 110 and 120 comprise resistive traces 210 and 220 on a ceramic substrate 230, which together define a ceramic heater 240 adapted to provide heat energy to a fuser belt. The processor 300, in accordance with this control scheme, generates activation signals to the triac 280 at appropriate zero-crossing intervals, which intervals are determined by the processor 300 by monitoring the pulses generated by the zero crossing detect circuit 290. Each activation signal is turned on at a zero-crossing interval and is turned off part way through a half-cycle of the AC line voltage signal from the power source S such that the triac 280 is turned on for one half cycle. The rate at which the triac 280 is activated is a function of the power required to be provided to the first and second resistive heating elements 110, 120. The required power level varies based on whether the fuser subassembly is in a power saver mode (a zero power level mode), a warm up mode (high power level mode), a print mode (intermediate or high power level mode) or a standby mode (very low power level mode for heated fuser roll(s) and a zero power level mode for a heated belt), as well as the weight, texture and type of the substrate. For example, seven separate power levels may be generated by the processor 300 during one or more fusing operations, where a single fusing operation involves one toned substrate passing through a fuser belt and a backup roll. During the first power level, the triac 280 is on for one out of seven (1/7) sequential current half-cycles, see P1 in FIG. 2. The current signal generated by the power source S is in phase with and of the same frequency as the voltage signal. During the second power level P2, the triac 280 is on for two out of seven (2/7) sequential half-cycles. During the third, fourth, fifth, sixth and seventh power levels P3, P4, P5, P6 and P7, the triac 280 is turned on, respectively, for 3/7; 4/7; 5/7; 6/7 and 7/7 sequential half-cycles. It is additionally contemplated that three separate power levels (i.e., the triac 280 is turned on for 1/3, 2/3 or 3/3 sequential half-cycles), fifteen separate power levels or any other number of separate power levels may be provided.

When the first and second resistive heating elements 110 and 120 comprise first and second lamps 230 and 240 or first and second filaments 232 and 242 within a dual filament lamp 250, the processor 300 controls the operation of the triac 280 in accordance with a dual pulse width modulation control scheme that is discussed in commonly assigned, co-pending patent application entitled "METHOD AND APPARATUS FOR CONTROLLING POWER TO A HEATER ELEMENT USING DUAL PULSE WIDTH MODULATION CONTROL," filed on Mar. 27, 2003, by Cao et al., and assigned U.S. Ser. No. 10/401,076, the disclosure of which is incorporated herein by reference.

It is further contemplated that, when the first and second resistive heating elements 110 and 120 comprise resistive traces 210 and 220 on a ceramic substrate 230, the processor 300 may alternatively control the operation of the triac 280 in accordance with the dual pulse width modulation control. It is additionally contemplated that when the first and second resistive heating elements 110 and 120 comprise first and second lamps 230 and 240 or first and second filaments 232 and 242, the processor 300 may alternatively control the operation of the triac 280 in accordance with a bang-bang control mode, which is discussed below, or an integer half cycle control mode.

In the illustrated embodiment, the fuse 285, relay 270, triac 280, zero crossing detect circuit 290 and opto isolator circuit 310 are provided in a power supply 295 for the printer, copier, or like device containing the universal fuser heating apparatus 100.

Figure 3B:
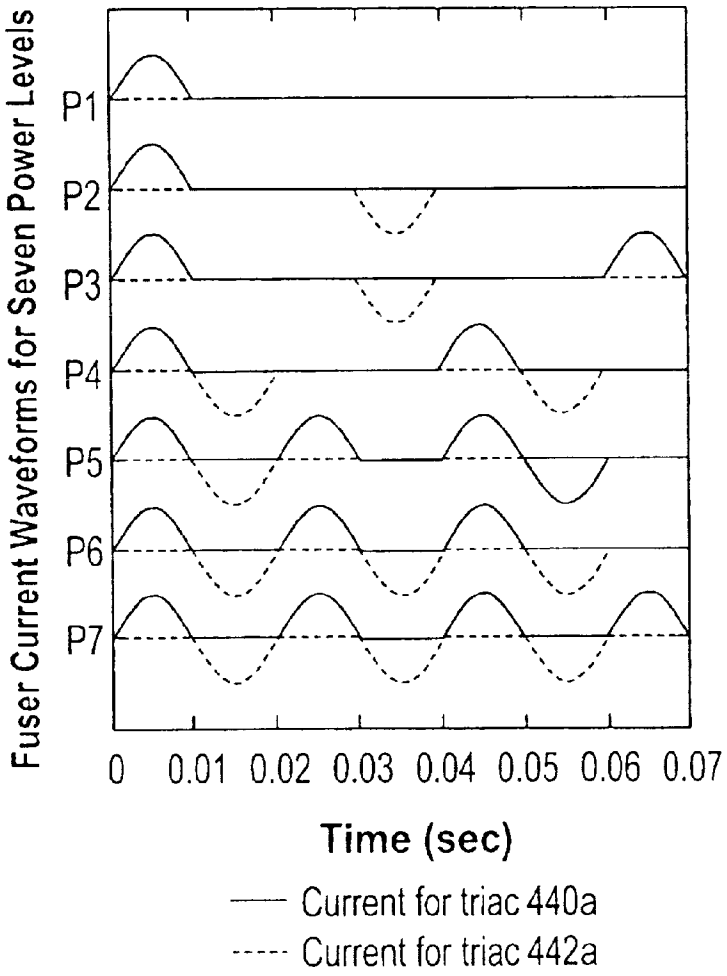
FIG. 3B illustrates current waveforms for seven power levels corresponding to integer half cycle control, dual frequency mode.
Figure 3:
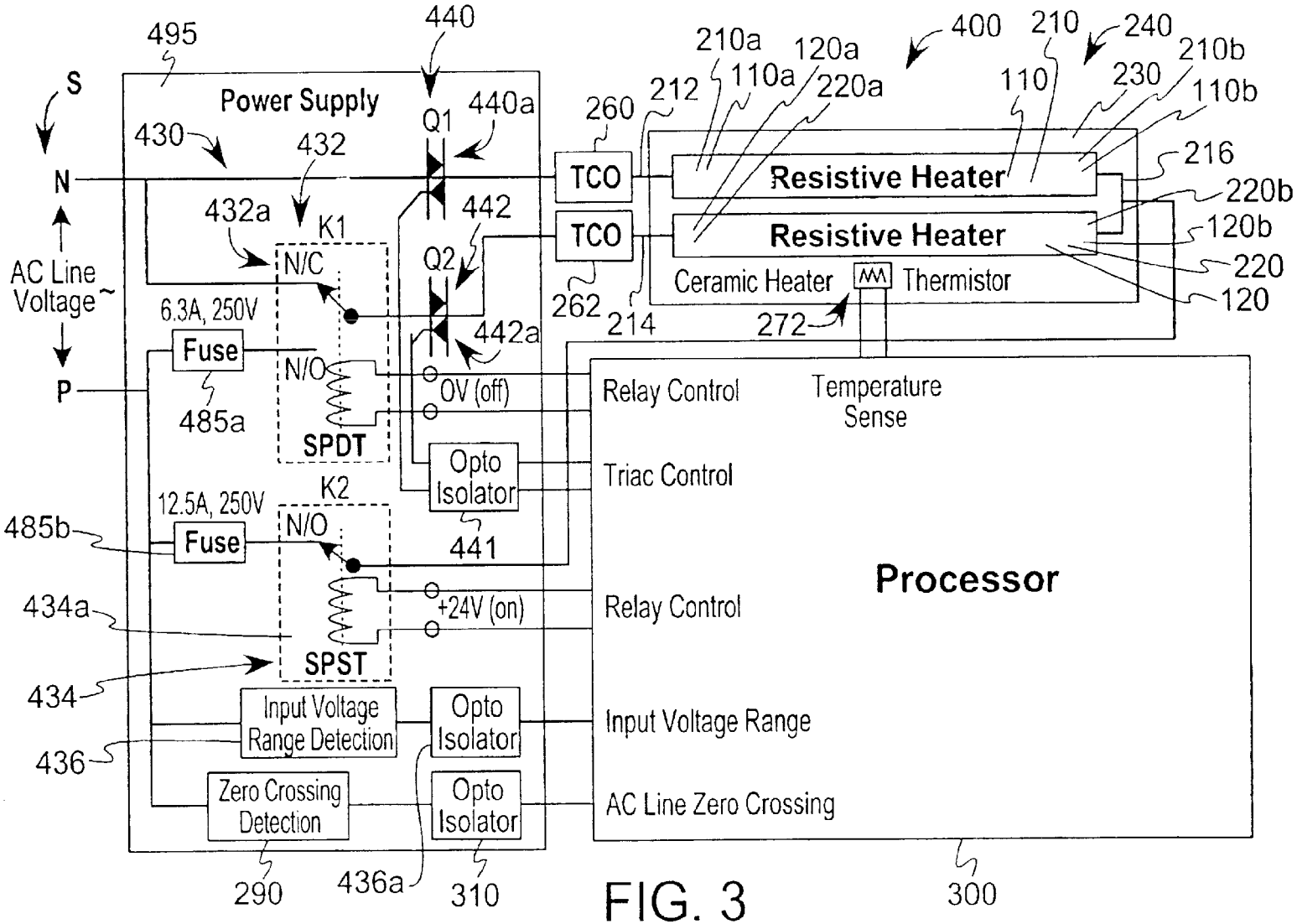
Figure 3A:
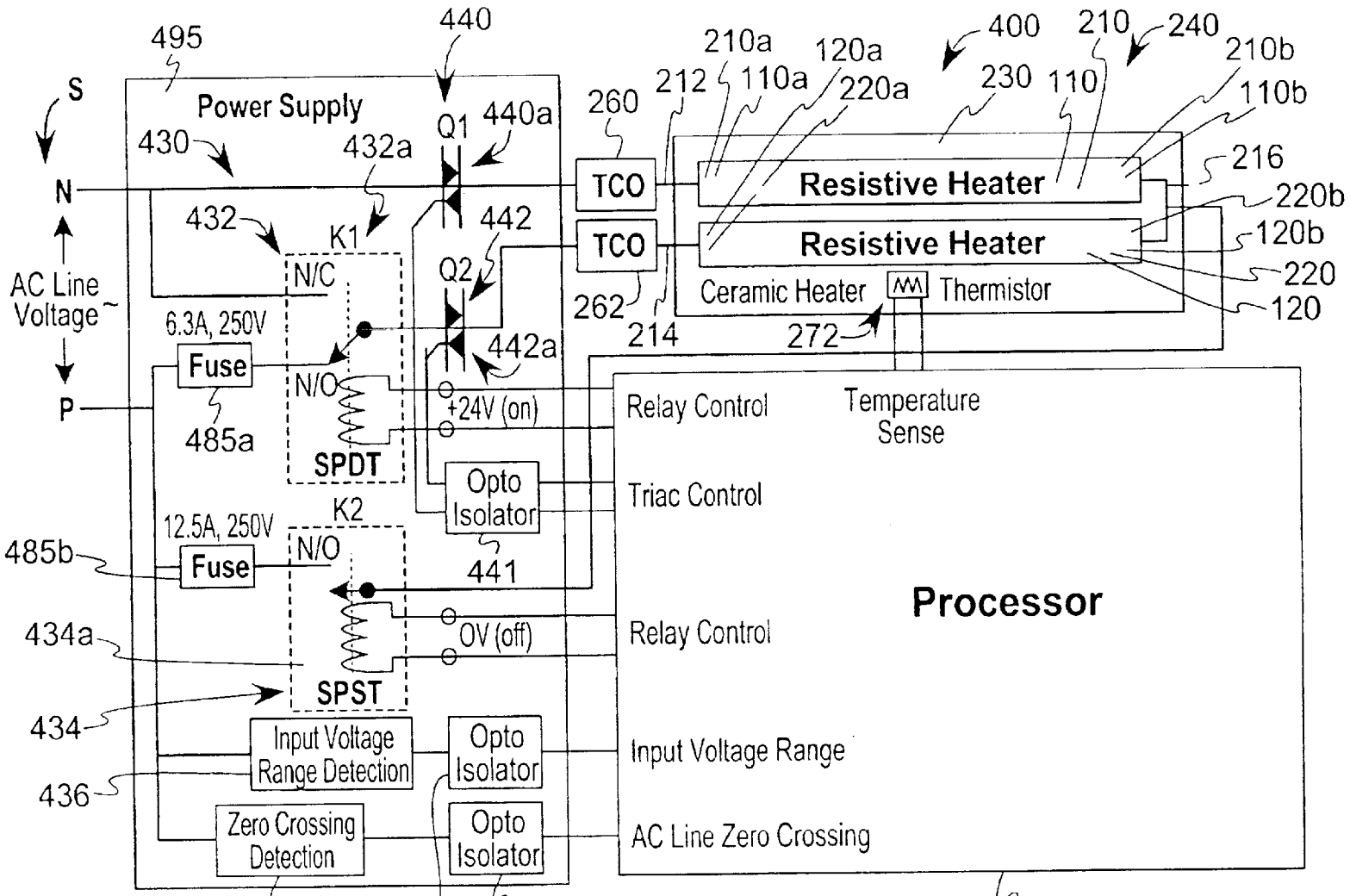
FIG. 3A illustrates a universal fuser heating apparatus constructed in accordance with a second embodiment of the present invention where a first relay is ON and a second relay is OFF.

A universal fuser heating apparatus 400, configured in accordance with a second embodiment of the present invention, is illustrated in FIGS. 3 and 3A, wherein like reference numerals indicate like elements. In this embodiment, structure 430 is provided for coupling the first and second resistive heating elements 110 and 120 in series or in parallel in dependence upon whether the apparatus 400 is to receive an input AC line voltage falling within one of the first and second low AC line voltage ranges or the high AC line voltage range. The structure 430 comprises a first switching element 432 comprising a first relay 432*a*, a second switching element 434 comprising a second relay 434*a*, an input voltage range detector or detection circuit 436 for detecting whether the input AC line voltage falls within one of the first and second low AC line voltage ranges or the high AC line voltage range, and a processor 300 coupled to the first and second relays 432*a* and 434*a* and the input voltage range detector 436. The first relay 432*a* is connected between the first and second terminals N and P of the power source S and the second resistive heating element 120 and, as noted above, is coupled to the processor 300. The second relay 434*a* is connected between the second terminal P of the power source S and the second ends 110*b* and 120*b* of the first and second resistive heating elements 110 and 120, and is also coupled to the processor 300. The input voltage range detector 436 is coupled between the second terminal P of the power source S and to the processor 300 through a conventional opto-isolator circuit 436*a* so as to prevent the AC line voltage signal from reaching the processor 300.

The relay 432*a* may comprise a single pole, double throw relay, one of which is commercially available from "NAiS" (Matsushita Electric Works, Ltd., Automation Controls Company), under the product designation "JW1FSNBDC24V," and the relay 434*a* may comprise a single pole, single throw relay, one of which is commercially available from "NAiS" (Matsushita Electric Works, Ltd., Automation Controls Company), under the product designation "JS1aFB24V."

It is noted that the input voltage range detector circuit 436 cannot accurately detect whether the input AC line voltage falls within either the first low voltage range or the second low voltage range. However, the circuit 436 can accurately detect whether the input AC line voltage falls within one of the first and second low voltage ranges, i.e., a single voltage range encompassing the first and second low voltage ranges, or the high voltage range, which is all that is required for this embodiment of the present invention.

Alternatively, it is contemplated that the processor 300 may determine whether the input AC line voltage is within the first, low voltage range, the second, low voltage range or the high voltage range by monitoring the temperature signal generated by the thermistor 272. That is, instead of an input voltage range detector 436 being provided, the processor 300 measures or determines the temperature rise time of the fuser roll or fuser belt so as to determine whether the input AC line voltage falls within the first, low voltage range, the second, low voltage range, or the high voltage range. More specifically, the time it takes to heat the fuser roll or fuser belt from a first temperature, e.g., 60 degrees C., to a second temperature, e.g., 90 degrees C., is measured. If the rise time occurs within a first predefined time period, the processor 300 concludes that the input AC line voltage falls within the first low range. If the rise time occurs within a second predefined time period, wherein the second time period is shorter than the first time period, the processor 300 concludes that the input AC line voltage falls within the second low range. If the rise time occurs within a third predefined time period, wherein the third time period is shorter than the first and second time periods, the processor 300 concludes that the input AC line voltage falls within the high range.

It is still further contemplated that the processor 300 may determine whether the input AC line voltage is within one of the first and second low voltage ranges, i.e., a single voltage range encompassing the first and second low voltage ranges, or the high voltage range by monitoring the temperature signal generated by the thermistor 272. More specifically, the time it takes to heat the fuser roll or fuser belt from a first temperature, e.g., 60 degrees C., to a second temperature, e.g., 90 degrees C., is measured. If the rise time occurs within a first predefined time period, the processor 300 concludes that the input AC line voltage falls within one of the first and second low ranges. If the rise time occurs within a second predefined time period, wherein the second time period is shorter than the first time period, the processor 300 concludes that the input AC line voltage falls within the high range.

When the input voltage range detector 436 or the processor 300 detects that the input AC line voltage generated by the power source S falls within one of the first and second low AC line voltage ranges, the processor 300 turns the first relay 432*a* OFF such the first relay 432*a* couples a first end 120*a* of the second resistive heating element 120 to the first terminal N of the power source S, see FIG. 3. The processor 300 also functions to turn the second relay 434*a* ON such that the second relay 434*a* couples the second ends 110*b* and 120*b* of the first and second resistive heating elements 110 and 120 to the second terminal P of the power source S. The first and second resistive heating elements 110 and 120 are in parallel with one another when the first relay 432*a* is OFF and the second relay 434*a* is ON, see FIG. 3.

When the input voltage range detector 436 or the processor 300 detects that the input AC line voltage generated by the power source S falls within the high voltage range the processor 300 turns the first relay 432*a* ON such that the first relay 432*a* couples the first end 120*a* of the second resistive heating element 120 to the second terminal P of the power source S, see FIG. 3A. The processor 300 also functions to turn the second relay 434*a* OFF such that the second relay 434*a* decouples the second ends 10*b* and 120*b* of the first and second resistive heating elements 110 and 120 from the second terminal P of the power source S. The first and second resistive heating elements 110 and 120 are in series with one another when the first relay 432*a* is ON and the second relay 434*a* is OFF, see FIG. 3A.

The apparatus 400 further comprises a first switching device 440, a first triac 440*a* in the illustrated embodiment, coupled between the first end 110*a* of the first resistive heating element 110 and the first terminal N of the power source S, and a second switching device 442, a second triac 442*a*, coupled between the first end 120*a* of the second resistive heating element 120 and one of the first and second terminals N and P of the power source S. As is apparent from FIGS. 3 and 3A, the first relay 432*a* is coupled between the first and second terminals N and P of the power source and the second triac 442*a*. The first and second triacs 440*a* and 442*a* are coupled to and controlled by the processor 300. A conventional opto isolator circuit 441 is provided between the triacs 440*a*, 442*a* and the processor 300 so as to prevent the AC line voltage signal generated by the power source S from reaching the processor 300. The first and second triacs 440*a* and 442*a* may comprise one which is commercially available from ST Microelectronics (Dallas, Tex.), under the product designation "BTA24-600BW."

A zero crossing detect circuit 290 is coupled to the second terminal P of the power source S and to the processor 300 through a conventional opto-isolator circuit 310.

When the first and second resistive heating elements 110 and 120 comprise resistive traces 210 and 220 on a ceramic substrate 230, which together define a ceramic heater 240 adapted to provide heat energy to a fuser belt, the processor 300 controls the operation of the triacs 440*a* and 442*a* in accordance with an integer half-cycle control scheme. More particularly, when the first relay 432*a* is ON and the second relay 434*a* is OFF, see FIG. 3A, such that the first and second resistive heating elements 110 and 120 are in series with one another, the processor 300 activates the first and second triacs 440*a*, 442*a* in accordance with an integer half-cycle control with activation of both triacs 440*a*, 442*a* being concurrently activated, i.e., both triacs 440*a*, 442*a* are activated simultaneously. The processor 300, in accordance with this control scheme, generates activation signals to the triacs 440*a* and 442*a* at appropriate zero-crossing intervals, which intervals are determined by the processor 300 by monitoring the pulses generated by the zero crossing detect circuit 290. Each activation signal is turned on at a zero-crossing interval and is turned off part way through a half-cycle of the AC line voltage signal from the power source S such that each triac 440*a*, 442*a* is turned on for one half cycle. The rate at which the triacs 440*a* and 442*a* are activated, i.e., the number of half cycles during which the triacs 440*a* and 442*a* are simultaneously activated, is a function of the power required to be provided to the first and second resistive heating elements 110, 120. The required power level varies based on whether the fuser subassembly is in a power saver mode (a zero power level mode), a warm up mode (high power level mode), a print mode (intermediate or high power level mode) or a standby mode (very low power level mode for heated fuser roll(s) and a zero power level mode for a heated belt), as well as the weight, texture and type of the substrate. For example, seven separate power levels may be generated by the processor 300 during one or more fusing operations, where a single fusing operation involves one toned substrate passing through a fuser belt and a backup roll. During the first power level, the triacs 440*a*, 442*a* are simultaneously activated for one out of seven (1/7) sequential current half-cycles. The current signal generated by the power source S is in phase with and of the same frequency as the voltage signal. During the second power level P2, the triacs 440*a*, 442*a* are simultaneously activated for two out of seven (2/7) sequential half-cycles. During the third, fourth, fifth, sixth and seventh power levels P3, P4, P5, P6 and P7, the triacs 440*a*, 442*a* are simultaneously activated for 3/7; 4/7; 5/7; 6/7 and 7/7 sequential half-cycles, respectively. The current waveforms for each triac 440*a*, 442 and corresponding to the seven power levels are similar to those illustrated in FIG. 2.

It is additionally contemplated that three separate power levels (i.e., the triacs 440*a*, 442*a* are activated for 1/3, 2/3 or 3/3 sequential half-cycles), fifteen separate power levels or any other number of separate power levels may be provided.

Integer half-cycle control with concurrent activation of both triacs 440*a*, 442*a* is also intended to encompass the situation where one of the triacs 440*a*, 442*a* is continuously activated via activation signals from the processor 300 while the other triac 440*a*, 442*a* is cycled ON and OFF in accordance with activation signals from the processor 300. Each activation signal is generated at appropriate zero-crossing intervals and turned off part way through a half-cycle of the AC line voltage signal from the power source S such that each triac 440*a*, 442*a* is turned on for one half cycle. The rate at which the other triac 440*a*, 442*a* is activated is a function of the power required to be provided to the first and second resistive heating elements 110, 120.

When the first relay 432*a* is OFF and the second relay 434*a* is ON, see FIG. 3, such that the first and second resistive heating elements 110 and 120 are in parallel with one another, the processor 300 may activate the first and second triacs 440*a*, 442*a* in accordance with the integer half-cycle control concurrent activation mode, as discussed above, where the first and second triacs 440*a*, 442*a* are activated simultaneously, or in accordance with an integer half-cycle control frequency-doubling mode. In the latter mode, only one of the triacs 440*a*, 442*a* is activated at any given time. This is illustrated by the example waveforms shown in FIG. 3B, where the waveforms corresponding to the first triac 440*a* are illustrated in solid line and the waveforms corresponding to the second triac 442*a* are illustrated in dotted line. In the illustrated embodiment, the resistances of the first and second resistive heating elements 110 and 120 are substantially the same. During the frequency-doubling mode, the peak current passing through whichever one of the first and second triacs 440*a*, 442*a* is activated is substantially the same as the peak current passing through each triac 440*a*, 442*a* in the concurrent activation mode, where the first relay 432*a* is OFF and the second relay 434*a* is ON in both modes. Since current passes through both triacs 440*a*, 442*a* during the concurrent activation mode and through only one triac 440*a*, 442*a* at any given time during the frequency-doubling mode, the total amount of current passing through the ceramic heater 240 is twice as much during the concurrent activation mode as during the frequency doubling mode. So as to achieve the same power level during the frequency-doubling mode as achieved during the concurrent activation mode, the frequency at which one of the first and second triacs 440*a*, 442*a* is activated, i.e., the number of half-cycles out of a predefined number of sequential half-cycles having at least one triac 440*a*, 442*a* activated, is doubled during the frequency-doubling mode, i.e., the activation frequency during the frequency-doubling mode is substantially twice the activation frequency during the concurrent activation mode. Because the total peak current through the ceramic heater 240 (i.e., the parallel combination of the first and second resistive heating elements 110, 120) is reduced in half during the integer half-cycle frequency-doubling mode, risk of flicker problems is reduced in that mode.

The processor 300, in accordance with the integer half-cycle frequency-doubling mode control scheme, generates activation signals to the triacs 440*a* and 442*a* at appropriate zero-crossing intervals, which intervals are determined by the processor 300 by monitoring the pulses generated by the zero crossing detect circuit 290. Each activation signal is turned on at a zero-crossing interval and is turned off part way through a half-cycle of the AC line voltage signal from the power source S such that the appropriate triac 440*a*, 442*a* is turned on for one half cycle.

The activation mode, i.e., concurrent activation mode or frequency-doubling mode, and the rate at which the triacs 440*a* and 442*a* are activated, i.e., the number of half cycles during which at least one of the triacs 440*a*, 442*a* is activated, is a function of the power required to be provided to the first and second resistive heating elements 110, 120. The required power level varies based on whether the fuser subassembly is in a power saver mode (a zero power level mode), a warm up mode (high power level mode), a print mode (intermediate or high power level mode) or a standby mode (very low power level mode for heated fuser roll(s) and a zero power level mode for a heated belt), as well as the weight, texture and type of the substrate. For example, the processor 300 typically generates activation signals to the triacs 440*a* and 442*a* in accordance with the concurrent activation mode during fuser subassembly warm up. The power requirements during the warm up mode are typically high. The processor 300 only generates activation signals to the triacs 440*a* and 442*a* in accordance with the frequency-doubling mode when the power requirement is below approximately 50% of the peak power which can be provided by the triacs 440*a* and 442*a*.

With regards to the frequency doubling mode, seven separate power levels may be generated by the processor 300 during one or more fusing operations, where a single fusing operation involves one toned substrate passing through a fuser belt and a backup roll. During the first power level, the triac 440*a* is on for one out of seven (1/7) sequential current half-cycles, while the triac 442*a* is not activated, see P1 in FIG. 3B. The current signal generated by the power source S is in phase with and of the same frequency as the voltage signal. During the second power level P2, each triac 440*a*, 442*a* is on for one half-cycle, which do not occur simultaneously. During the third, fourth, fifth, sixth and seventh power levels P3, P4, P5, P6 and P7, the triacs 440*a*, 442*a* are activated for a combined number of half-cycles equal to 3/7; 4/7; 5/7; 6/7 and 7/7, respectively. It is additionally contemplated that three separate power levels, fifteen separate power levels or any other number of separate power levels may be provided.

When the first and second resistive heating elements 110 and 120 comprise first and second lamps 230 and 240 or first and second filaments 232 and 242 within a dual filament lamp 250, the processor 300 controls the operation of the triacs 440*a*, 442*a* in accordance with the dual pulse width modulation control, noted above.

It is further contemplated that, when the first and second resistive heating elements 110 and 120 comprise resistive traces 210 and 220 on a ceramic substrate 230, the processor 300 may alternatively control the operation of the triacs 440*a*, 442*a* in accordance with dual pulse width modulation control. It is additionally contemplated that, when the first and second resistive heating elements 110 and 120 comprise first and second lamps 230 and 240 or first and second first and second filaments 232 and 242, the processor 300 may alternatively control the operation of the triacs 440*a*, 442*a* in accordance with a bang-bang control mode, which is discussed below, or integer half cycle control.

In the illustrated embodiment, the resistance of the first resistive heating element 110 is substantially equal to the resistance of the second resistive heating element 120. It is also contemplated that the first and second resistive heating elements 110 and 120 may have different resistances. In either case, the resistances of the first and second heating elements 110 and 120 are selected such they have a first, low effective resistance, when in parallel with one another, corresponding to the AC line voltage falling within one of the low AC line voltage ranges, and a second, high effective resistance, when in series with one another, corresponding to the AC line voltage falling within the high AC line voltage range. Consequently, regardless of the AC line voltage provided, high current levels, which might create unacceptable flicker problems, are avoided.

The universal fuser heating apparatus 400 further comprises thermal cut off devices 260 and 262 coupled to the first and second resistive heating elements 110 and 120, respectively, which devices 260 and 262 are substantially identical to those illustrated in the FIG. 1 embodiment.

The relays 432*a* and 434*a* may also function as thermal safety devices in combination with a thermistor 272. In the illustrated embodiment, the thermistor 272 is provided directly on the substrate 230. When the processor 300, after sampling the temperature signal generated by the thermistor 272, determines that the temperature sensed by the thermistor 272 exceeds a threshold level, the processor 300 disconnects the power source S from the first and second resistive heating elements 110, 120. More specifically, when the input AC line voltage generated by the power source S falls within the high voltage range such that the first relay 432*a* is ON and the second relay 434*a* is OFF and the processor 300 determines that the temperature sensed by the thermistor 272 exceeds the threshold level, the processor 300 turns the first relay 432*a* OFF so as to disconnect power to the first and second resistive heating elements 110, 120. When the input AC line voltage generated by the power source S falls within a low voltage range such that the first relay 432*a* is OFF and the second relay 434*a* is ON and the processor 300 determines that the temperature sensed by the thermistor 272 exceeds the threshold level, the processor 300 turns the second relay 434*a* OFF so as to disconnect power to the first and second resistive heating elements 110, 120.

A first fuse 485*a*, for example a 6.3A, 250 V fuse, is coupled between the first relay 432*a* and the second terminal P of the power source S and a second fuse 485*b*, for example a 12.5A, 250V fuse, is coupled between the second relay 434*a* and the second terminal P. Fuse 485*a* or fuse 485*b* opens if the current passing through it exceeds a threshold value. The fuses 485*a*, 485*b* may open instantaneously when the threshold current level is reached or after a predefined period of time.

The first and second resistive heating elements 110 and 120 may comprise first and second lamps 230, 240, as illustrated in FIG. 1E, first and second resistive traces 210, 220, as illustrated in any one of FIGS. 1A–1D, or first and second filaments 232, 242 as illustrated in FIG. 1F.

In the illustrated embodiment, the fuses 485*a*, 485*b*, relays 432*a*, 434*a*, triacs 440*a*, 442*a*, opto isolator circuit 441, input voltage range detector 436, opto isolator circuit 436*a*, zero crossing detect circuit 290, and opto isolator circuit 310 are provided in a power supply 495 for the printer, copier, or like device containing the universal fuser heating apparatus 400.

Figure 4:
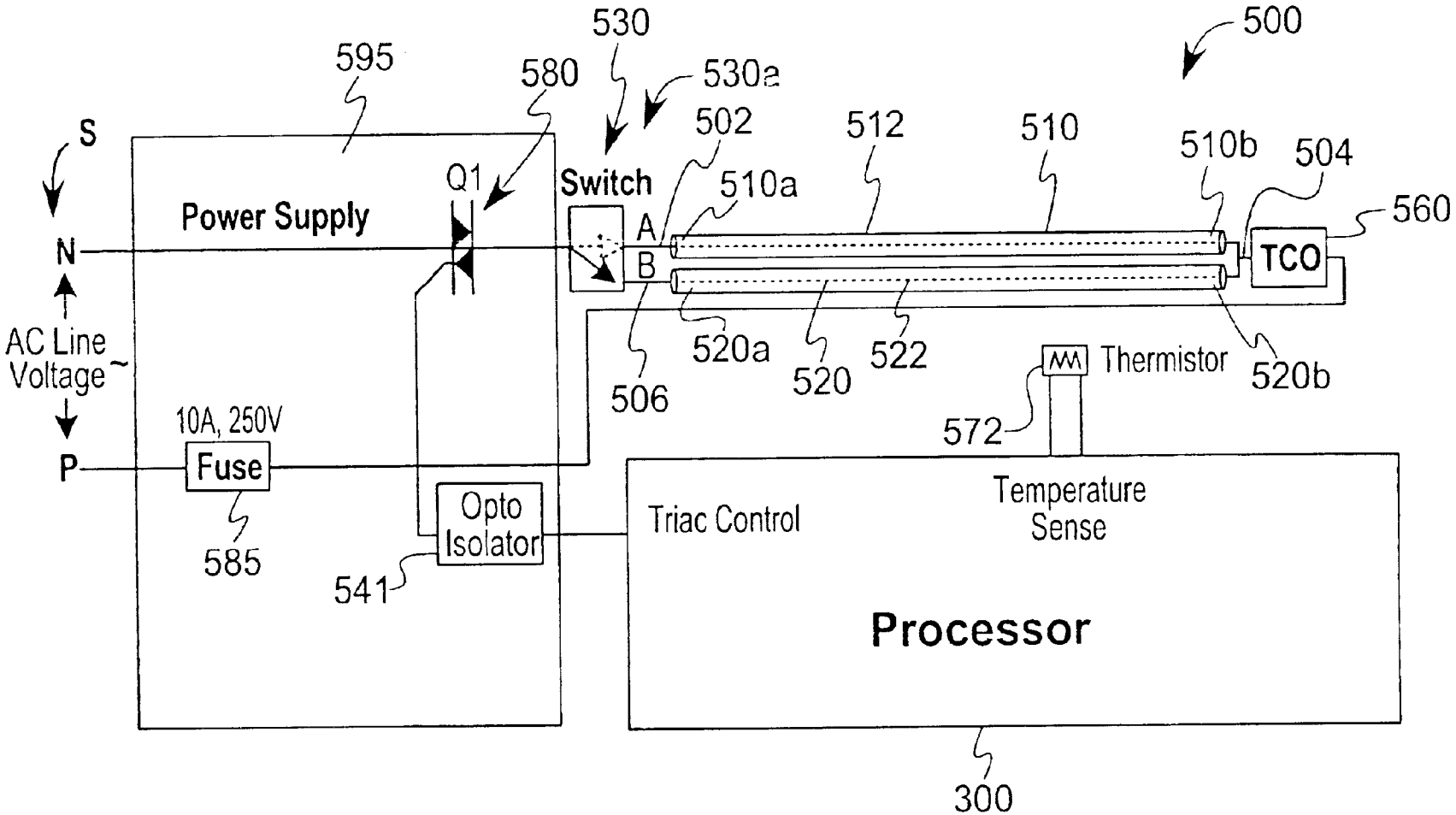
FIG. 4 illustrates a universal fuser heating apparatus constructed in accordance with a third embodiment of the present invention.

A universal fuser heating apparatus 500, configured in accordance with a third embodiment of the present invention, is illustrated in FIG. 4, wherein like reference numerals indicate like elements. In this embodiment, the universal fuser heating apparatus 500 comprises a first resistive heating element 510 rated for receiving an AC line voltage falling in either the first low AC line voltage range or the second low AC line voltage range, a second resistive heating element 520 rated for receiving an AC line voltage falling within the high AC line voltage range, and structure 530 for coupling one of the first and second resistive heating elements 510 and 520 to the power source S in dependence upon whether the AC line voltage generated by the power source falls within one of the low AC line voltage ranges or the high voltage range.

The structure 530 may comprise a selection switch 530*a* (also referred to herein as an "element") capable of being manually moved between first and second positions. The switch 530*a* is moved to the first position, shown in phantom in FIG. 4, when the AC line voltage generated by the power source falls within one of the low AC line voltage ranges so as to couple, via conductor 502, a first end 510*a* of the first resistive heating element 510 to a first terminal N of the power source with a second end 510*b* of the first resistive heating element 510 being connected via conductor 504 to a second terminal P of the power source S. The switch 530*a* is moved to the second position, shown in solid line in FIG. 4, when the AC line voltage generated by the power source S falls within the high voltage range so as to couple, via conductor 506, a first end 520*a* of the second resistive heating element 520 to the first terminal N of the power source S with a second end 520*b* of the second resistive heating element 520 being connected via conductor 504 to the second terminal P of the power source S.

The selection switch 530*a* may be mounted within the fuser subassembly, e.g., in a removable fuser subassembly module, or in another location, i.e., not in the fuser subassembly, in the printer, copier or other device in which the universal fuser heating apparatus 500 is incorporated so that it is only accessible to a service technician.

In the embodiment illustrated in FIG. 4, the first and second resistive heating elements 510 and 520 comprise first and second lamps 512, 522. The first and second resistive heating elements 510 and 520 may also comprise first and second filaments within a dual filament lamp, which are similar to the filaments 232, 242 illustrated in FIG. 1F.

Figure 4A:
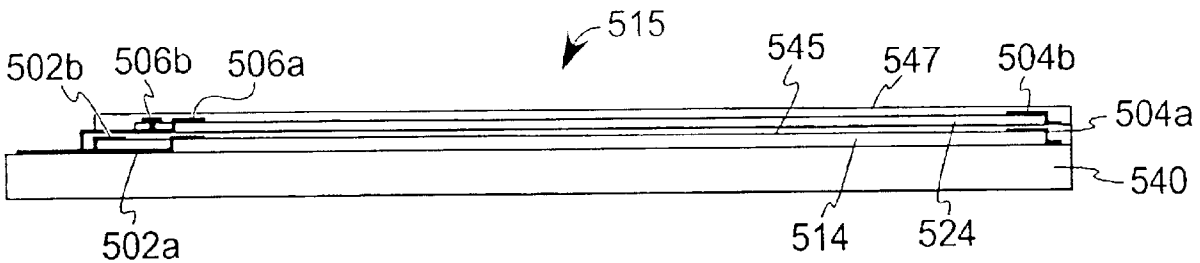
FIGS. 4A–4C illustrate resistive traces for use in universal fuser heating apparatuses constructed in accordance with third and fourth embodiments of the present invention.
Figure 4C:
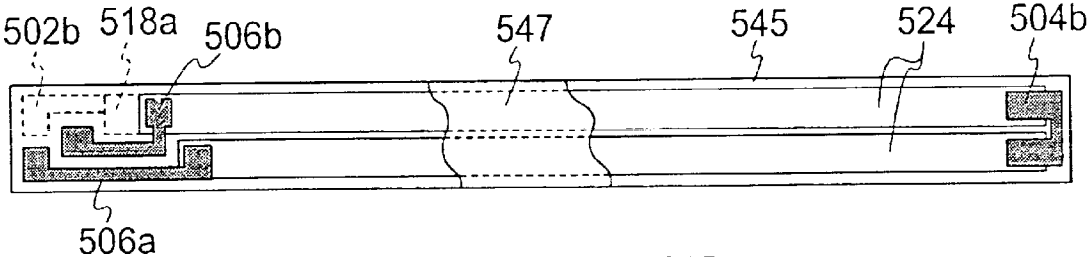
Figure 4D:
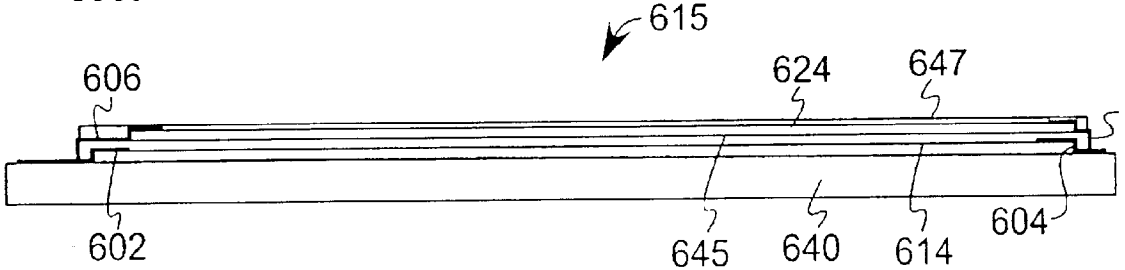
FIGS. 4D–4F illustrate resistive traces for use in universal fuser heating apparatuses constructed in accordance with third and fourth embodiments of the present invention.
Figure 4F:
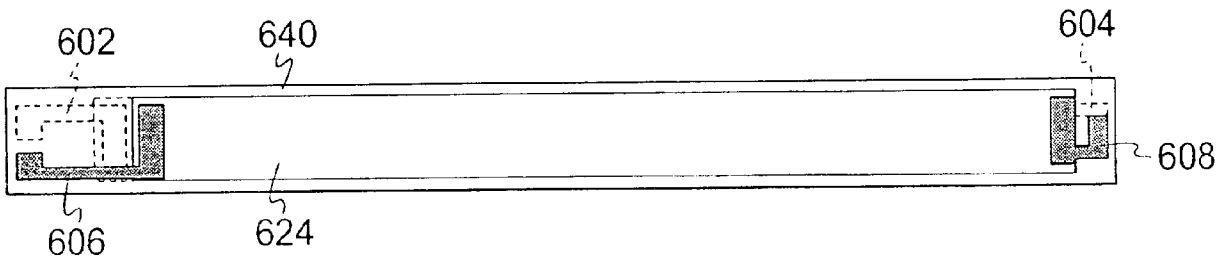
Figure 4B:
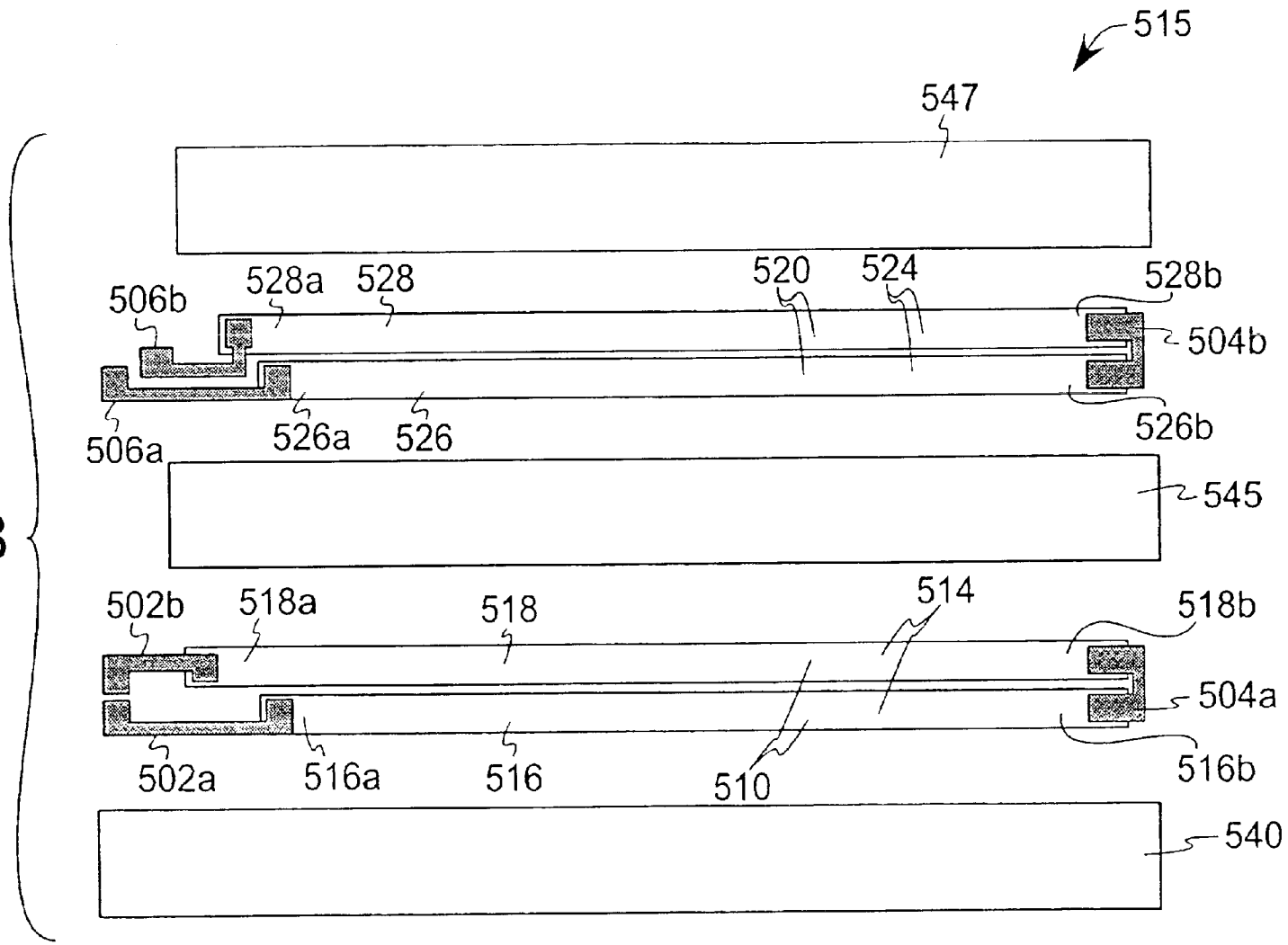

It is further contemplated that the first and second resistive heating elements 510, 520 may comprise first and second resistive traces 514 and 524, see FIGS. 4A–4C. FIG. 4A is a side, cross sectional view of a resistive heater 515 containing the first and second resistive traces 514, 524; FIG. 4B is an exploded view illustrating the layers of the resistive heater 515 separated from one another; and FIG. 4C is a top view with a second insulation layer 547 removed. The resistive heater 515 is adapted to heat a fuser belt 515*a* as illustrated in FIG. 4H. A backup roll 515*b* contacts the belt 515*a* so as to define a nip for receiving a toned substrate TS.

In the embodiment illustrated in FIGS. 4A–4C, the first resistive trace 514 is formed on a ceramic substrate 540 and comprises first and second subtraces 516 and 518. The first end 516*a* of the first subtrace 516 is coupled to a first conductor 502*a* and the first end 518*a* of the second subtrace 518 is coupled to a second conductor 502*b*. Second ends 516*b* and 518*b* of the first and second subtraces 516 and 518 are coupled to a third conductor 504*a*. A first insulation layer 545 is provided over the first resistive trace 514. The second resistive trace 524 is formed over the insulation layer 545 and comprises third and fourth subtraces 526 and 528. A first end 526*a* of the third subtrace 526 is coupled to a fourth conductor 506*a* and the first end 528*a* of the fourth subtrace 528 is coupled to a fifth conductor 506*b*. The second ends 526*b* and 528*b* of the third and fourth subtraces 526 and 528 are coupled to a sixth conductor 504*b*. A second insulation layer 547 is formed over the second resistive trace 524. The conductors 502*a*, 502*b*, 506*a*, 506*b* extend out from the first and second insulation layers 545 and 547. Hence, as is apparent from FIG. 4A, the second resistive trace 524 substantially overlies the first resistive trace 514.

The first and second insulation layers 545 and 547 comprise either a single layer of insulation material or two or more layers of insulation material.

When the first and second resistive heating elements 510, 520 comprise first and second resistive traces 514, 524 and the switch 530*a* is moved to the first position, corresponding to the AC line voltage generated by the power source S falling within one of the low AC line voltage ranges, the first resistive trace 514 is coupled to the first terminal N of the power source S via conductor 502*b* and the first resistive trace 514 is coupled to the second terminal P of the power source S via conductor 502*a*. The switch 530*a* is moved to the second position, when the AC line voltage generated by the power source S falls within the high voltage range so as to couple the second resistive trace 524 to the first terminal N of the power source S via conductor 506*b* and to the second terminal P of the power source S via conductor 506*a*.

Figure 4E:
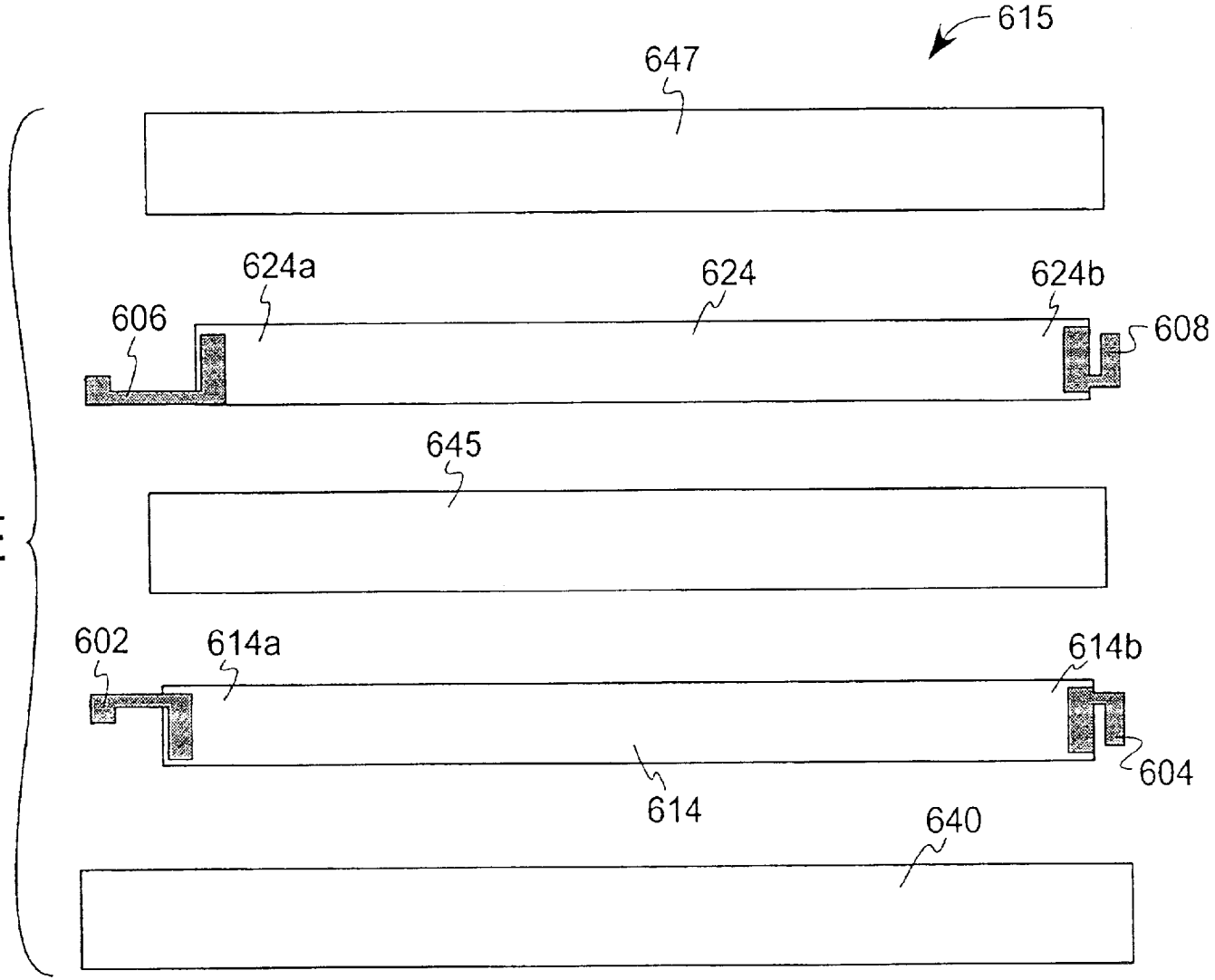

In a further alternative embodiment, the first and second resistive heating elements 510, 520 may comprise first and second resistive traces 614 and 624, see FIGS. 4D–4F. FIG. 4D is a side, cross sectional view of a resistive heater 615 containing the first and second resistive traces 614, 624; FIG. 4E is an exploded view illustrating the layers of the resistive heater 615 separated from one another; and FIG. 4F is a top view with a second insulation layer 647 removed. The resistive heater 615 is adapted to heat a fuser belt 515*a* as illustrated in FIG. 4H. The first resistive trace 614 is formed on a ceramic substrate 640. The first end 614*a* of the first trace 614 is coupled to a first conductor 602 and the second end 614*b* of the first trace 614 is coupled to a second conductor 604. A first insulation layer 645 is provided over the first resistive trace 614. The second resistive trace 624 is formed over the insulation layer 645. A first end 624*a* of the second trace 624 is coupled to a third conductor 606 and the second end 624*b* of the second trace 624 is coupled to a fourth conductor 608. A second insulation layer 647 is formed over the second resistive trace 624. The conductors 602, 604, 606 and 608 extend out from the first and second insulation layers 645 and 647. Hence, as is apparent from FIG. 4D, the second resistive trace 624 substantially overlies the first resistive trace 614.

The first and second insulation layers 645 and 647 comprise either a single layer of insulation material or two or more layers of insulation material.

When the first and second resistive heating elements 510, 520 comprise the first and second resistive traces 614, 624, illustrated in FIGS. 4D–4F, and the switch 530*a* is moved to the first position, corresponding to the AC line voltage generated by the power source S falling within one of the low AC line voltage ranges, the first resistive trace 614 is coupled to the first terminal N of the power source S via conductor 602 and the first resistive trace 614 is coupled to the second terminal P of the power source S via conductor 604. The switch 530*a* is moved to the second position, when the AC line voltage generated by the power source S falls within the high voltage range so as to couple the second resistive trace 624 to the first terminal N of the power source S via conductor 606 and to the second terminal P of the power source S via conductor 608.

The processor 300 is also coupled to a triac 580, which is provided between the first terminal N of the power source S and the selection switch 530*a*, see FIG. 4. The triac 580 may comprise one, which is commercially available from ST Microelectronics (Dallas, Tex.), under the product designation "BTA24-600BW." The processor 300 may control the operation of the triac 580 in accordance with a bang-bang control mode. This control mode involves maintaining the corresponding fuser roll containing the lamps 512 and 522 within a predefined temperature window. When the processor 300, based on the temperature signal generated by the thermistor 572, determines that the temperature of the fuser roll is below the lower value of the temperature window, the processor 300 activates the triac 580, so as to allow power generated by the power source S to pass to one of the lamps 512, 522, until the temperature of the fuser roll, as indicated by the signal generated by the thermistor 572, is above the upper value of the temperature window, at which point the triac 580 is turned off.

An integer half-cycle control scheme is used when the first and second resistive heating elements 510, 520 comprise the first and second resistive traces 514, 524 or 614, 624. Alternatively, a dual pulse-width modulation control may be provided.

It is additionally contemplated that, when the first and second resistive heating elements 510 and 520 comprise first and second lamps 512 and 522 or first and second filaments, the processor 300 may alternatively control the operation of the triac 580 in accordance with integer half cycle control or dual pulse-width modulation control.

In the embodiments illustrated in FIGS. 4, 4A–4C and 4D–4F, the first resistive heating element 510 (i.e., the lamp 512 or first resistance trace 514, 614) has a resistance which is lower than that of the second resistive heating element 520 (i.e., the lamp 522 or the second resistance trace 524, 624). The resistance values for the first and second heating elements 510 and 520 are selected so as to maintain current levels passing through the first and second resistive heating elements 510 and 520 at levels so as to avoid unacceptable flicker problems.

Further provided, as illustrated in FIG. 4, is thermal cut off device 560. The device 560 is coupled between the second ends 510*b* and 520*b* of the first and second resistive heating elements 510 and 520 and the second terminal P of the power source S. The cut off device 560 is also positioned near or in engagement with the first and second resistive heating elements 510 and 520 so as to be heated by the heating elements 510 and 520. When the device 560 is heated to a predefined threshold temperature, it is actuated so as to disconnect the resistive heating elements 510, 520 from the power source S. Hence, the thermal cut off device 560 functions as a thermal safety device. The device 560 may comprise one-shot bimetal thermostats, which are commercially available from Wako Electronics Co., Ltd. (Osaka, Japan). When the first and second resistive heating elements 510 and 520 comprise first and second resistive traces, the preferred Wako thermostat comprises "Model No. CH-16." When the first and second resistive heating elements 510 and 520 comprise lamps or filaments, the preferred Wako thermostat comprises "Model No. CH-152-35."

When the universal fuser heating apparatus 500 comprises a resistive heater 515, 615 for providing heat energy to a belt, a relay may be provided to function as a safety device in conjunction with the thermistor 572 just as the relay 270 and thermistor 272 work in conjunction as a safety device in the FIG. 1 embodiment. A zero cross detection circuit may also be provided so as to synchronize the triac control signals to the 0 voltage crossings of the AC line voltage generated by the power source S.

A fuse 585, for example a 10A, 250 V fuse, is coupled between the second terminal P of the power source S and the second ends of the first and second resistive heating elements 510 and 520. Fuse 585 opens if the current passing through it exceeds a threshold value. The fuse 585 may open instantaneously when the threshold current level is reached or after a predefined period of time.

In the illustrated embodiment, the fuse 585, triac 580, and opto isolator circuit 541 are provided in a power supply 595 for the printer, copier, or like device containing the universal fuser heating apparatus 500.

In the manual switch embodiment illustrated in FIG. 4, and when the first and second resistive heating elements 510 and 520 comprise first and second lamps 512, 522 or first and second filaments 512*a*, 522*a* within a dual filament lamp, the first and second lamps 512, 522 or first and second filaments 512*a*, 522*a* may be positioned an equal distance away from the thermistor 572 so that the thermistor 572 is heated equally by the lamps 512, 522 or filaments 512*a*, 522*a*. As illustrated in FIG. 41, the lamps 512, 522 or filaments 512*a*, 522*a* are positioned symmetrically about a plane extending from the thermistor 572 to the center C of the fuser roll 900 containing the lamps 512, 522 or filaments 512*a*, 522*a*. If the lamps 512, 522 or filaments 512*a*, 522*a* are spaced unequal distances away from the thermistor 572, the processor 300 preferably needs to know which lamp or filament is currently being activated so as to adjust or correct the temperature readings derived from the signal generated by the thermistor 572 as a lamp or filament nearer the thermistor 572 will result in a higher uncorrected temperature reading than a lamp or filament spaced further away from the thermistor 572. However, in the FIG. 41 configuration, because the first and second lamps 512, 522 or first and second filaments 512*a*, 522*a* are positioned an equal distance away from the thermistor 572 the processor 300 does not need to know the position of the lamp or filament currently being activated so as to take into consideration its distance away from the thermistor 572 in processing the temperature signals generated by the thermistor 572.

Figure 4G:
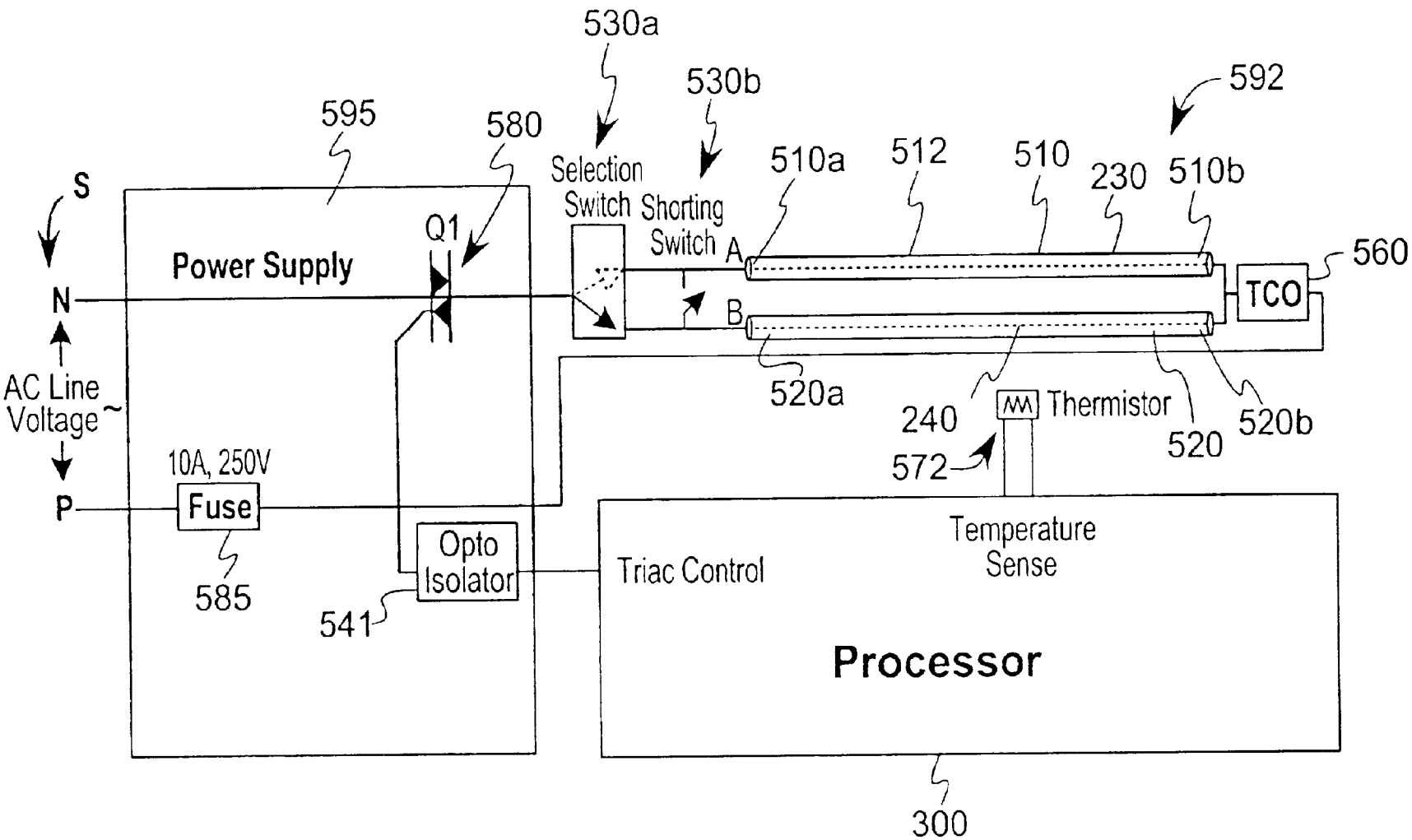
FIG. 4G illustrates a universal fuser heating apparatus constructed in accordance with a modification of the third embodiment of the present invention.
Figure 4H:
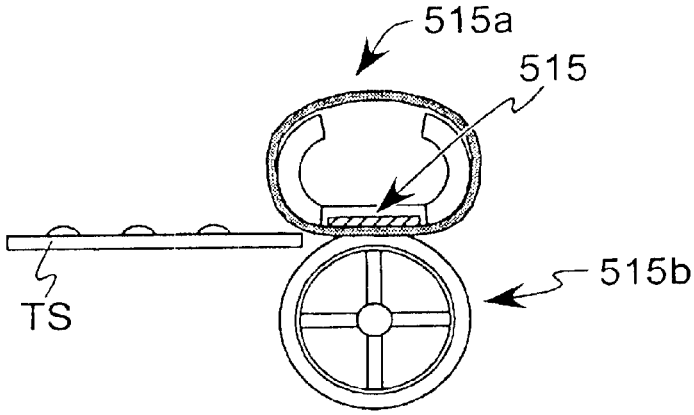
FIG. 4H illustrates a fuser belt and a resistive heater for heating the belt.
Figure 4I:
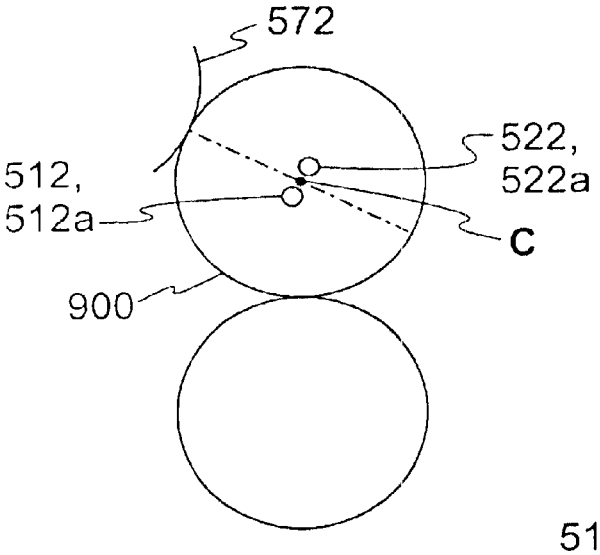
FIG. 4I illustrates preferred locations of lamps or filaments for the embodiment of FIG. 4.

A modification of the third embodiment is illustrated in FIG. 4G, wherein like reference numerals indicate like elements. In FIG. 4G, the universal fuser heating apparatus 592 is constructed in substantially the same manner as the fuser heating apparatus 500 illustrated in FIG. 4, however a second manually operated switch 530*b* is provided, which, when activated, couples together the first ends 510*a* and 520*a* of the first and second heating elements 510 and 520 such that those heating elements are in parallel with one another. The switch 530*b* is activated so as to couple the first ends 510*a* and 520*a* of the first and second heating elements 510 and 520 together when the AC line voltage generated by the power source S falls within the first low AC line voltage range. When coupled together in parallel, the first and second resistive heating elements 510 and 520 have an effective resistance lower than that of either heating element 510, 520 when considered individually. Hence, the low effective resistance corresponds to the low AC line voltage range. When the switch 530*b* is activated, the first switch 530*a* may be in either a first position, shown in phantom in FIG. 4G, or a second position, shown in solid line in FIG. 4G.

When the AC line voltage generated by the power source S falls within the second low AC line voltage range, the first switch 530*a* is moved to its first position, shown in phantom in FIG. 4G, and the second switch 530*b* is deactivated or opened so as to couple a first end 510*a* of the first resistive heating element 510 to a first terminal N of the power source S with a second end 510*b* of the first resistive heating element 510 being connected to a second terminal P of the power source S. The first switch 530*a* is moved to its second position, shown in solid line in FIG. 4G, and the second switch 530*b* is opened when the AC line voltage generated by the power source S falls within the high voltage range so as to couple a first end 520*a* of the second resistive heating element 520 to the first terminal N of the power source S with a second end 520*b* of the second resistive heating element 520 being connected to the second terminal P of the power source S.

It is additionally contemplated the switches 530*a* and 530*b* may be replaced by a single switch (not shown) having three separate positions. The switch is moved between its three separate positions manually. When the AC line voltage generated by the power source S falls within the second low AC line voltage range, the switch is moved to a first position so as to couple a first end 510*a* of the first resistive heating element 510 to a first terminal N of the power source S with a second end 510*b* of the first resistive heating element 510 being connected to a second terminal P of the power source S. The switch is moved to a second position when the AC line voltage generated by the power source S falls within the high voltage range so as to couple a first end 520*a* of the second resistive heating element 520 to the first terminal N of the power source S with a second end 520*b* of the second resistive heating element 520 being connected to the second terminal P of the power source S. When the AC line voltage generated by the power source S falls within the first low AC line voltage range, the switch is moved to a third position so as to couple first ends 510*a* and 520*a* of the first and second resistive heating elements 510 and 520 to the first terminal N of the power source S with the second ends 510*b* and 520*b* of the first and second resistive heating elements 510 and 520 being coupled to the second terminal P of the power source S such that the first and second resistive heating elements 510 and 520 are in parallel with one another.

Figure 5A:
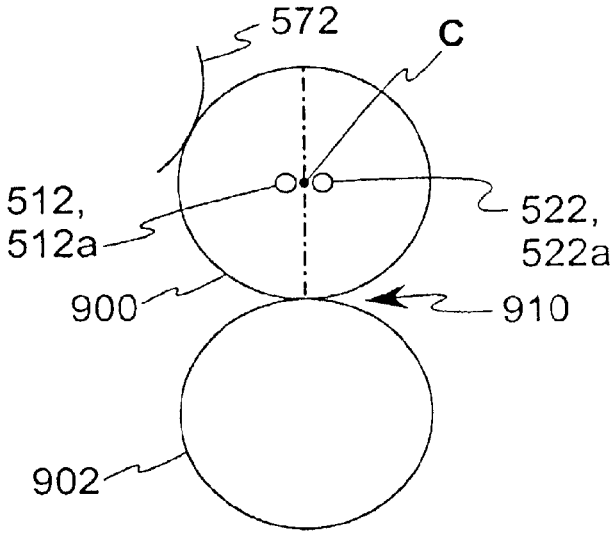
FIG. 5A illustrates preferred locations of lamps or filaments for the embodiment of FIG. 5.
Figure 5:
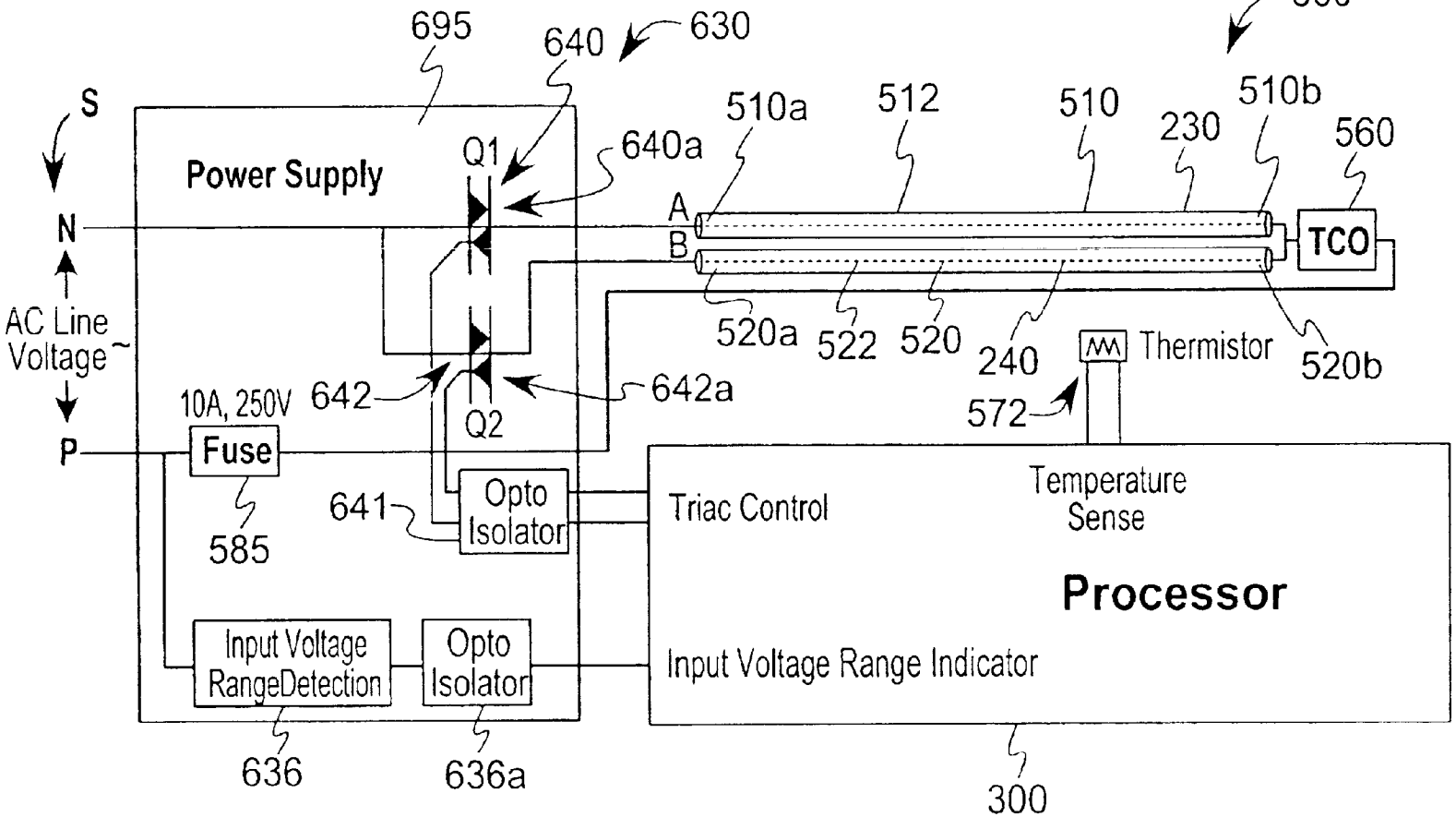
FIG. 5 illustrates a universal fuser heating apparatus constructed in accordance with a fourth embodiment of the present invention.

A universal fuser heating apparatus 600, configured in accordance with a fourth embodiment of the present invention, is illustrated in FIG. 5, wherein like reference numerals indicate like elements. In this embodiment, the universal fuser heating apparatus 600 comprises a first resistive heating element 510 rated for receiving an AC line voltage falling in either the first low AC line voltage range or the second low AC line voltage range, a second resistive heating element 520 rated for receiving an AC line voltage falling within the high AC line voltage range, and structure 630 for coupling one of the first and second resistive heating elements 510 and 520 to the power source S in dependence upon whether the AC line voltage generated by the power source falls within one of the low AC line voltage ranges or the high voltage range.

In the embodiment illustrated in FIG. 5, the first and second resistive heating elements 510 and 520 comprise first and second lamps 512, 522. The first and second resistive heating elements 510 and 520 may also comprise first and second filaments within a dual filament lamp similar to the filaments 232, 242 illustrated in FIG. 1F. It is further contemplated that the first and second resistive heating elements 510, 520 may comprise first and second resistive traces 514, 524, as illustrated in FIGS. 4A–4C, or first and second resistive traces 614, 624, as illustrated in FIGS. 4D–4F.

The structure 630 comprises a first switching device 640, a first triac 640*a* in the illustrated embodiment, a second switching device 642, a second triac 642*a*, an input voltage range detector or detecting circuit 636 for detecting whether the input AC line voltage falls within one of the first and second low voltage ranges or the high voltage range, and a processor 300 coupled to the first and second triacs 640*a* and 642*a* and the input voltage range detector 636. An opto isolator circuit 636*a* is provided between the input voltage range detector 636 and the processor 300 so as to prevent the AC line voltage signal generated by the power source S from reaching the processor 300. An opto isolator circuit 641 is provided between the triacs 640*a*, 642*a* and the processor 300 so as to prevent the AC line voltage signal generated by the power source S from reaching the processor 300. The first and second triacs 640*a* and 640*b* may comprise one which is commercially available from ST Microelectronics (Dallas, Tex.), under the product designation "BTA24-600BW."

The input voltage range detector 636 cannot accurately determine whether the input AC line voltage falls within either the first low voltage range or the second low voltage range. It can, however, determine if the input AC line voltage falls within one of the first and second low voltage ranges i.e., a single voltage range encompassing the first and second low voltage ranges, or the high voltage range. When the input voltage range detector 636 determines that the input AC line voltage generated by the power source S falls within one of the first and second low voltage ranges, the processor 300 activates the first triac 640*a* such the first triac 640*a* couples a first end 510*a* of the first resistive heating element 510 to the first terminal N of the power source S. The second end 510*b* of the first resistive heating element 510 is coupled to the second terminal P of the power source S. Hence, current flows through the first resistive heating element 510.

As noted above, in the illustrated embodiment, the first and second resistive heating elements 510 and 520 comprise first and second lamps 512 and 522 contained within a fuser roll. A thermistor 572 contacts the outer surface of the fuser roll and generates a temperature signal to the processor 300. If the first and second resistive heating elements comprise first and second resistive traces 514, 524, as illustrated in FIGS. 4A–4C, or first and second resistive traces 614, 624, as illustrated in FIGS. 4D–4F, the thermistor 572 is coupled to or formed on the ceramic substrate on which the traces are formed.

The processor 300, by monitoring the temperature signal generated by the thermistor 572, measures or determines the temperature rise time of the fuser roll or fuser belt so as to determine whether the input AC line voltage falls within the first, low voltage range or the second, low voltage range. More specifically, the time it takes to heat the fuser roll or fuser belt from a first temperature, e.g., 60 degrees C., to a second temperature, e.g., 90 degrees C., is measured. If the rise time occurs within a first predefined time period, e.g., 14.5 seconds to 20 seconds, the processor 300 concludes that the input AC line voltage falls within the first low range. If the rise time occurs within a second predefined time period, e.g., 7 seconds to 14.5 seconds, wherein the second time period is shorter than the first time period, the processor 300 concludes that the input AC line voltage falls within the second low range.

When the processor 300 determines that the input AC line voltage is within the second, low voltage range, it continues to only activate the first triac 640*a*. When the processor 300 determines that the input AC line voltage is within the first, low voltage range, it activates both the first and second triacs 640*a* and 642*a*, such that the first and second resistive heating elements 510 and 520 are in parallel with one another.

When the input voltage range detector 636 detects that the input AC line voltage falls within the high voltage range the processor 300 only activates the second triac 642*a* such that the second triac 642*a* couples the first end 520*a* of the second resistive heating element 520 to the first terminal N of the power source S. Hence, in this mode, current only flows through the second resistive heating element 520.

Alternatively, it is contemplated that the processor 300 may determine whether the input AC line voltage is within the first, low voltage range, the second, low voltage range or the high voltage range by monitoring the temperature signal generated by the thermistor 572. That is, instead of an input voltage range detector 636 being provided, the processor 300 measures or determines the temperature rise time of the fuser roll or fuser belt so as to determine whether the input AC line voltage falls within the first, low voltage range, the second, low voltage range, or the high voltage range. More specifically, the time it takes to heat the fuser roll or fuser belt from a first temperature, e.g., 60 degrees C., to a second temperature, e.g., 90 degrees C., is measured. If the rise time occurs within a first predefined time period, the processor 300 concludes that the input AC line voltage falls within the first low range. If the rise time occurs within a second predefined time period, wherein the second time period is shorter than the first time period, the processor 300 concludes that the input AC line voltage falls within the second low range. If the rise time occurs within a third predefined time period, wherein the third time period is shorter than the first and second time periods, the processor 300 concludes that the input AC line voltage falls within the high range.

It is still further contemplated that the processor 300 may determine whether the input AC line voltage is within one of the first and second low voltage ranges, i.e., a single voltage range encompassing the first and second low voltage ranges, or the high voltage range by monitoring the temperature signal generated by the thermistor 572. More specifically, the time it takes to heat the fuser roll or fuser belt from a first temperature, e.g., 60 degrees C., to a second temperature, e.g., 90 degrees C., is measured. If the rise time occurs within a first predefined time period, the processor 300 concludes that the input AC line voltage falls within one of the first and second low ranges. If the rise time occurs within a second predefined time period, wherein the second time period is shorter than the first time period, the processor 300 concludes that the input AC line voltage falls within the high range. When the processor 300 determines that the input AC line voltage generated by the power source S falls within one of the first and second low voltage ranges, the processor 300 activates the first triac 640*a* such the first triac 640*a* couples a first end 510*a* of the first resistive heating element 510 to the first terminal N of the power source S. When the processor 300 detects that the input AC line voltage falls within the high voltage range the processor 300 only activates the second triac 642*a* such that the second triac 642*a* couples the first end 520*a* of the second resistive heating element 520 to the first terminal N of the power source S.

The processor 300 may control the operation of the triacs 640*a* and 642*a* in accordance with a bang-bang control mode. This control mode involves maintaining the corresponding fuser roll (not shown) containing the lamps 512 and 522 within a predefined temperature window. When the processor 300, based on the temperature signal generated by the thermistor 572, determines that the temperature of the fuser roll is below the lower value of the temperature window, the processor 300 activates one or both of the triacs 640*a*, 642*a*, such that current is allowed to flow continuously through either one or both of the first and second lamps 512 and 522 until the temperature of the fuser roll, as indicated by the signal generated by the thermistor 572, is above the upper value of the temperature window, at which point the triacs 640*a*, 642*a* are turned off.

An integer half-cycle control scheme is used when the first and second resistive heating elements 510, 520 comprise the first and second resistive traces 514, 524 or 614, 624 as discussed above with regard to the FIG. 2 embodiment. When the first and second resistive heating elements 510 and 520 are in parallel with one another, the processor 300 activates the first and second triacs 540*a*, 542*a* in accordance with an integer half-cycle control concurrent activation mode, i.e., where both triacs 540*a*, 542*a* are activated simultaneously. Alternatively, a dual pulse-width modulation control may be provided.

It is additionally contemplated that, when the first and second resistive heating elements 510 and 520 comprise the first and second lamps 512 and 522 or first and second filaments, the processor 300 may alternatively control the operation of the triacs 514, 524 in accordance with integer half cycle control or dual pulse-width modulation control.

In the embodiment illustrated in FIG. 5, the first resistive heating element 510 (i.e., the lamp 512 or first resistance trace 514, 614) has a resistance, which is lower than that of the second resistive heating element 520 (i.e., the lamp 522 or the second resistance trace 524, 624). The resistance values for the first and second heating elements 510 and 520 are selected so as to maintain current levels passing through the first and second resistive heating elements 510 and 520 at levels so as to avoid unacceptable flicker problems.

Further provided, as illustrated in FIG. 5, is thermal cut off device 560. The device 560 is coupled between the second ends 510*b* and 520*b* of the first and second resistive heating elements 510 and 520 and the second terminal P of the power source S. The cut off device 560 is also positioned near or in engagement with the first and second resistive heating elements 510 and 520 so as to be heated by the heating elements 510 and 520. When the device 560 is heated to a predefined threshold temperature, it is actuated so as to disconnect the resistive heating elements 510, 520 from the power source S. Hence, the thermal cut off device 560 functions as a thermal safety device. The device 560 may comprise a one-shot bimetal thermostat, ones of which are commercially available from Wako Electronics Co., Ltd. (Osaka, Japan). When the first and second resistive heating elements 510 and 520 comprise first and second resistive traces, the preferred Wako thermostat comprises "Model No. CH-16." When the first and second resistive heating elements 510 and 520 comprise lamps or filaments, the preferred Wako thermostat comprises "Model No. CH-152-35."

When the universal fuser heating apparatus 600*a* comprises a resistive heater 515, 615 for providing heat energy to a belt, a relay may be provided to function as a safety device in conjunction with the thermistor 572 just as the relay 270 and the thermistor 272 work in conjunction as safety devices in the FIG. 1 embodiment. A zero cross detection circuit may also be provided so as to synchronize the triac control signals to the 0 voltage crossings of the AC line voltage generated by the power source S.

A fuse 585, for example a 10A, 250 V fuse, is coupled between the second terminal P of the power source S and the second ends of the first and second resistive heating elements 510 and 520. Fuse 585 opens if the current passing through it exceeds a threshold value. The fuse 585 may open instantaneously when the threshold current level is reached or after a predefined period of time.

In the illustrated embodiment, the fuse 585, triacs 640*a*, 642*a*, opto isolator circuit 641, input voltage range detection circuit 636 and opto isolator circuit 636*a* are provided in a power supply 695 for the printer, copier, or like device containing the universal fuser heating apparatus 500.

In the embodiment illustrated in FIG. 5, where the structure 630 comprises an input voltage range detecting circuit 636, and when the first and second resistive heating elements 510 and 520 comprise first and second lamps 512, 522 or first and second filaments 512*a*, 522*a* within a dual filament lamp, the first and second lamps 512, 522 or first and second filaments 512*a*, 522*a* may be positioned relative to a fuser nip 910, defined by a heated fuser roll 900 and a backup roll 902, so that the nip 910 is heated equally by the lamps 512, 522 or first and second filaments 512*a*, 522*a*, see FIG. 5A. Because the processor 300 will know which lamp or filament is being activated, i.e., either the first or the second resistive heating element 510, 520, the processor 300 can access a corresponding look-up table to determine the fuser nip temperature given the temperature read by the thermistor 572, even though the thermistor 572 will be heated unequally by the lamps 512, 522 or filaments 512*a*, 522*a* due to the lamps 512 and 522 or filaments 512*a* and 522*a* being located at different distances from the thermistor 572. As illustrated in FIG. 5A, the lamps 512, 522 or filaments 512*a*, 522*a* are positioned symmetrically about an axis extending from the fuser nip to the center C of the fuser roll 900 containing the lamps 512, 522 or filaments 512*a*, 522*a*.

What is claimed is:

1. A universal fuser heating apparatus capable of receiving an input AC line voltage falling within at least one low AC line voltage range or a high AC line voltage range, said universal fuser heating apparatus comprising:

a first resistive heating element;

a second resistive heating element; and structure for coupling said first and second resistive heating elements in series or in parallel in dependence upon whether the fuser heeling apparatus will receive an input AC line voltage falling within said at least one low AC line voltage range or said high AC line voltage range;

a switching device associated with one of said first and second resistive heating elements; and a processor coupled to said switching device for activating said switching device in accordance with an integer half-cycle control scheme, wherein at least two different power levels are available via the integer half-cycle control scheme.

2. A universal fuser heating apparatus as set forth in claim 1, wherein said structure comprises an element capable of being manually moved between first and second positions, said element being moved to said first position so as to couple first ends of said first and second resistive heating elements to a first terminal of a first power source generating an AC line voltage failing within said at least one low AC line voltage range and second ends of said first and second resistive heating elements to a second terminal of the first power source such that said first and second resistive heating elements are in parallel with one another, and said element being moved to said second position so as to couple said first end of said first resistive heating element to a first terminal of a second power source generating an AC line voltage falling within said high AC line voltage range and said first end of said second resistive heating clement to the second terminal of the second power source such that said first and second resistive heating elements are in series with one another.

3. A universal fuser heating apparatus as set forth in claim 2, wherein said movable element comprises a movable jumper switch.

4. A universal fuser heating apparatus as set forth in claim 2, wherein said movable element comprises a movable connector.

5. A universal fuser heating apparatus as set forth in claim 1, wherein said at least one low AC line voltage range comprises a first low AC line voltage range and a second, low AC line voltage range, said thirst low AC line voltage range is from about 90 VAC to about 110 VAC, said second low AC line voltage range is from about 100 VAC to about 127 VAC and said high AC line voltage range is front about 200 VAC to about 240 VAC.

6. A universal fuser heating apparatus as set forth in claim 1, wherein said first and second resistive heating elements comprise first and second filaments within a dual filament lamp.

7. A universal fuser heating apparatus as set forth in claim 1, wherein said first and second resistive heating elements comprise first and second lamps, first and second filaments within a dual filament lamp or first and second resistive traces.

8. A universal fuser heating apparatus capable of receiving an input AC line voltage falling within at least one low AC line voltage range or a high AC line voltage range, said universal fuser heating apparatus comprising:

a first resistive heating element;

a second resistive heating element; and structure for coupling said first and second resistive heating elements in series or in parallel in dependence upon whether the fuser heating apparatus will receive on input AC line voltage falling within said at least one low AC line voltage range or said high AC line voltage range, said structure comprising a first switching element, a second switching element, an input voltage range detector for detecting whether the input AC line voltage falls within said at least one low AC line voltage range or said high AC line voltage range, and a processor coupled to said first and second switching elements and said input voltage range detector; and a first switching device associated with said first resistive heating element and a second switching device associated with said second resistive heating element, said first and second switching devices being coupled to and controlled by said processor.

9. A universal fuser heating apparatus as set forth in claim 8, wherein said input voltage range detector detects that the input AC line voltage falls within said at least one low AC line voltage range said processor turning said first switching element OFF such said first switching element couples a first end of said second resistive heating element to a first terminal of a first power source generating the AC line voltage falling within said at least one low AC line voltage range and turning said second switching element ON such that said second switching element couples second ends of said first and second resistive heating elements to a second terminal of said first power source, said first and second resistive heating elements being in parallel with one another when said first switching element is OFF and said second switching element is ON, and when said input voltage range detector detects that the input AC line voltage falls within said high voltage range said processor turning said first switching element ON such that said first switching element couples the first end or said second resistive heating element to a second terminal of a second power source generating the AC line voltage falling within the high AC line voltage range and turning said second switching element OFF such that said second switching element decouples the second ends of said first and second resistive heating elements from said second terminal of said second power source, said first and second resistive heating elements being in series with one another when said first switching element is ON and said second switching element is OFF.

10. A universal fuser heating apparatus as set forth in claim 9, wherein said first and second switching elements comprise first and second relays.

11. A universal fuser heating apparatus as set forth in claim 8, wherein said processor activates said first and second switching devices in accordance with an integer half-cycle control scheme so as to control the amount of power provided to said first and second resistive heating elements.

12. A universal fuser heating apparatus as let forth in claim 8, wherein said processor activates said first and second switching devices in one of a concurrent activation mode and a frequency doubling mode.

13. A universal fuser heating apparatus as set forth in claim 8, wherein said first switching device comprises a first triac coupled to said first end of said first resistive heating element and said second switching device comprises a second triac coupled to said first end of the second resistive heating element.

14. A universal fuser heating apparatus capable of receiving an input AC line voltage falling within at least one low AC line voltage range or a high AC line voltage range, said universal fuser heating apparatus comprising:

a first resistive heating element;

a second resistive heating element; and structure for coupling said first and second resistive heating elements in series or in parallel in dependence upon whether the fuser heating apparatus will receive an input AC line voltage falling within said at least one low AC line voltage range or said high AC line voltage range, said structure comprising a processor for monitoring a temperature signal generated by a thermistor so as to determine a temperature rise time of a fuser roll or a fuser belt so as to determine whether the input AC line voltage falls within said at least one low AC line voltage range or said high AC line voltage range.

15. A universal fuser heating apparatus capable of receiving an input AC line voltage generated by a power source, said AC line voltage falling within a first low AC line voltage range, a second low AC line voltage range or a high AC line voltage range, said universal fuser heating apparatus comprising:

a first resistive heating element rated for receiving an AC line voltage failing within one of said first and second low AC line voltage ranges;

a second resistive heating element rated for receiving an AC line voltage falling within the high voltage range; and structure for coupling at least one of said first and second resistive heating elements to the power source in dependence upon whether the AC line voltage generated by the power source falls within said first low AC line voltage range, said second low AC line voltage range or said high voltage range.

16. A universal fuser heating apparatus as set forth in claim 15, wherein said structure comprises a first element capable of being manually moved between at least first and second positions, said first element being moved to said first position when the AC line voltage generated by the power source falls within at least one of said first and second low AC line voltage ranges so as to couple a first end of said first resistive heating element to a first terminal of the power source, and a second end of said first resistive heating element to a second terminal of the power source, and said first element being moved to said second position when the AC line voltage generated by the power source falls within said high voltage range so as to couple a first end of said second resistive heating element to the first terminal of the power source and a second end or said second resistive heating element to the second terminal of the power source.

17. A universal fuser heating apparatus as set forth in claim 16, wherein said first resistive heating element has a resistance which is lower than that of said second resistive heating element.

18. A universal fuser heating apparatus as set forth in claim 16, wherein at least a portion of said first low AC line voltage range being less than the entire second, low AC line voltage range, said first element being in said first position when the AC line voltage generated by the power source falls within said second low AC line voltage range, and said first element being capable of being moved to a third position when the AC line voltage generated by the power source falls within said first low AC line voltage range so as to couple said first ends of said first and second resistive heating elements to a first terminal of the power source thereby causing said first and second resistive heating elements to be in parallel with one another.

19. A universal fuser heating apparatus as set forth in claim 16, wherein at least a portion of said first low AC line voltage range being less than the entire second, low AC line voltage range, said first element being in said first position when the AC line voltage generated by the power source falls within said second low AC line voltage range, and further comprising a second element capable of being actuated when the AC line voltage generated by the power source falls within said first low AC line voltage range so as to couple said first ends of said first and second resistive heating elements to a first terminal of the power source thereby causing said first and second resistive heating elements to be in parallel with one another.

20. A universal fuser heating apparatus as set forth in claim 15, wherein said first and second resistive heating elements comprise first and second lamps, first and second filaments of a dual filament lamp or first and second resistive traces.

21. A universal fuser heating apparatus as set forth in claim 15, wherein said first and second resistive heating elements comprise first and second filaments within a dual filament lamp, said first filament being rated for receiving an AC line voltage falling within one of said first and second low voltage ranges and said second filament being rated for receiving an AC line voltage falling within the high voltage range.

22. A universal fuser heating apparatus as set forth in claim 15, wherein said structure comprises a processor for monitoring a temperature signal generated by a thermistor so as to determine a temperature rise time of a fuser roll or a fuser belt so as to determine whether the input AC line voltage falls within one of said first and second low AC line voltage ranges or said high AC line voltage range.

23. A universal fuser heating apparatus as set forth in claim 15, further comprising at least one thermal cut off device positioned adjacent to one of said first and second resistive heating elements.

24. A universal fuser heating apparatus as set forth in claim 15, wherein said first low AC line voltage range is from about 90 VAC to about 110 VAC, said second low AC line voltage range is from about 100 VAC to about 127 VAC and said high AC line voltage range is from about 200 VAC to about 240 VAC.

25. A universal fuser heating apparatus capable of receiving an input AC line voltage generated by a power source, said AC line voltage falling within a first low AC line voltage range, a second low AC line voltage range or a high AC line voltage range, said universal fuser heating apparatus comprising:

a first resistive heating element rated for receiving an AC line voltage falling within one of said first and second low AC line voltage ranges;

a second resistive heating element rated for receiving an AC line voltage falling within the high voltage range; and structure for coupling at least one of said first and second resistive heating elements to the power source in dependence upon whether the AC line voltage generated by the power source falls within one of said first and second low AC line voltage ranges or said high voltage range, said structure comprising:

a first switching device;

a second switching device;

an input voltage range detector for detecting whether the input AC line voltage falls within said at least one low voltage range or the high voltage range; and a processor coupled to said first and second switching devices and said input voltage range detector.

26. A universal fuser heating apparatus as set forth in claim 25, wherein when said input voltage range detector detects that the input AC line voltage falls within one of said first and second low voltage ranges said processor activating said first switching device such that said first switching device couples a first end of said first resistive heating element to a first terminal of the power source, and when said input voltage range detector detects that the input AC line voltage falls within the high voltage range said processor activating said second switching device such that said second switching device couples the first end of said second resistive heating element to the first terminal of said power source.

27. A universal fuser heating apparatus as set forth in claim 26, wherein said processor activates said first switching device in accordance with an integer half-cycle control scheme so as to control the amount of power provided to said first resistive heating element when said input voltage range detector detects that the input AC line voltage falls within one of said first and second low voltage ranges, and said processor activates said second switching device in accordance with an integer half-cycle control scheme so as to control the amount of power provided to said second resistive heating element when said input voltage range detector detects that the input AC line voltage falls within the high voltage range.

28. A universal fuser heating apparatus as set forth in claim 26, wherein said first switching device comprises a first triac coupled to said first end of said first resistive heating element and said second switching device comprises a second triac coupled to said first end of the second resistive heating element.

29. A universal fuser heating apparatus as set forth in claim 25, wherein at least a portion of said first low AC line voltage range being less than the entire second low AC line voltage range, and said processor activating said first and second switching devices when the AC line voltage generated by the power source falls within said first low AC line voltage range so as to couple said first ends of said first and second resistive heating elements to a first terminal of the power source thereby causing said first and second resistive heating elements to be in parallel with one another.

30. A universal fuser heating apparatus as set forth in claim 29, wherein said processor monitors a temperature signal generated by a thermistor so as to determine a temperature rise time of a fuser roll or a fuser belt so as to determine whether the input AC line voltage falls within said first low AC line voltage range or said second low AC line voltage range.

31. A fuser heating apparatus capable of receiving an input AC line voltage comprising:

a first resistive heating element;

a second resistive heating element;

a first switching device associated with said first resistive heating element;

a second switching device associated with said second resistive heating element;

a processor coupled to said first and second switching devices and activating said first and second switching devices in accordance with an integer half-cycle control in a frequency doubling mode so as to control the amount of power provided to said first and second resistive heating elements, said processor being capable of activating said first and second switching devices in accordance with an integer half-cycle control in a frequency doubling mode such that at least two different power levels are available.

32. A fuser heating apparatus as set forth in claim 31, wherein said first and second switching devices comprise first and second triacs.

33. A universal fuser heating apparatus capable of receiving an input AC line voltage falling within at least one low AC line voltage range or a high AC line voltage range, said universal fuser heating apparatus comprising:

a first resistive heating element;

a second resistive heating element; and structure for coupling said first and second resistive heating elements in series or in parallel in dependence upon whether the fuser heating apparatus will receive an input AC line voltage falling within said at least one low AC line voltage range or said high AC line voltage range;

a switching device associated with one of said first and second resistive heating elements; and a processor coupled to said switching device for activating said switching device in accordance with a dual pulse width modulation control scheme.

* * * * *